US012171344B1

(12) United States Patent
Andreae

(10) Patent No.: US 12,171,344 B1
(45) Date of Patent: Dec. 24, 2024

(54) FOLDABLE BREATHE-THROUGH SLEEP STRUCTURE

(71) Applicant: Julie A. Andreae, Grosse Pointe Park, MI (US)

(72) Inventor: Julie A. Andreae, Grosse Pointe Park, MI (US)

( * ) Notice: Subject to any disclaimer, the term of this patent is extended or adjusted under 35 U.S.C. 154(b) by 121 days.

(21) Appl. No.: 17/693,383

(22) Filed: Mar. 13, 2022

Related U.S. Application Data

(63) Continuation-in-part of application No. 17/515,428, filed on Oct. 30, 2021, now abandoned.

(60) Provisional application No. 63/107,938, filed on Oct. 30, 2020.

(51) Int. Cl.
*A47D 15/00* (2006.01)

(52) U.S. Cl.
CPC ..... *A47D 15/003* (2013.01)

(58) Field of Classification Search
CPC ..... A47D 15/003; A47D 7/00; A47D 15/001; A47D 15/008; A47D 5/00; A47D 9/00; A47D 9/005; A47D 13/063; A47D 7/002; A47D 9/012; A47D 9/016; A47D 5/006; A47C 29/003; A47C 23/24
USPC ..... 5/93.1, 98.1, 99.1, 652.1, 724, 655, 604; 135/133, 136, 156
See application file for complete search history.

(56) References Cited

U.S. PATENT DOCUMENTS 3,339,213 A * 9/1967 Spencer ..... A47D 13/063 256/25
4,692,953 A * 9/1987 Fetters ..... A47D 9/005 5/99.1
5,161,764 A * 11/1992 Roney ..... F16M 11/18 248/231.71
8,696,400 B2 * 4/2014 Fair ..... B62B 5/082 24/581.1
11,160,391 B2 * 11/2021 Schaffer ..... A47D 11/007
2012/0180217 A1 * 7/2012 Obriot ..... A47D 15/008 5/604
2013/0198957 A1 * 8/2013 Obriot ..... A47D 15/001 5/604
2014/0318587 A1 * 10/2014 Anderson, Jr. ..... E04H 15/48 135/155
2016/0324326 A1 * 11/2016 McCoy ..... A47C 17/52
2017/0105548 A1 * 4/2017 D'Urso ..... A47C 23/24
2018/0020843 A1 * 1/2018 Hornor ..... F16M 11/38 5/655

OTHER PUBLICATIONS

"Knurled." Dicitonary.com, Date Available: Sep. 15, 2016,www.dictionary.com/browse/knurled (Year: 2016).*

(Continued)

*Primary Examiner* — Adam C Ortiz
*Assistant Examiner* — Madison Emanski
(74) *Attorney, Agent, or Firm* — Robert M. Miller

(57) ABSTRACT

A foldable breathe-through mattress comprises a foldable base frame, a top frame assembly, a flexible mat, and a topper, the top frame assembly may comprise a first arm, a second arm, a first frame clip, and a second frame clip. The first and second frame clips are generally attachable to the foldable base frame and the first and the second arms are generally attached by hinges to the first and the second frame clips. The flexible mat may be removably attached to a bottom of the foldable base frame. The topper may be removably attached to the first and the second arms of the top frame assembly.

19 Claims, 20 Drawing Sheets

(56) References Cited

OTHER PUBLICATIONS

"Thumbscrew." Dicitonary.com, Date Available: Dec. 1, 2016, www.dictionary.com/browse/thumbscrew (Year: 2016).*

* cited by examiner

SECTION A-A

FOLDABLE BREATHE-THROUGH SLEEP STRUCTURE

This application relates to U.S. Application Ser. No. 17/515,428, filed Oct. 30, 2021, which claims priority to U.S. Provisional Application No. 63/107,938, filed Oct. 30, 2020, all of which are hereby incorporated by reference in their entirety.

FIELD OF THE INVENTION

The invention relates to sleeping and resting surfaces generally and, more particularly, to a method and/or apparatus for implementing a foldable breathe-through sleep structure.

BACKGROUND

Infants, toddlers, and occasionally small children tend to sleep in cribs. Traditional cribs are often purchased along with a traditional foam or spring mattress as a set. When an infant expels bodily fluids in the crib, these mattresses may become unsanitary, as the bodily fluids may tend to pool or collect around the infant's body. Cleaning these mattresses can be cumbersome and sometimes ineffective, as the bacteria, germs and other matter can become embedded in the mattress. Traditional mattresses can also inhibit the breathing of the infant and/or cause the infant to re-breath a potentially harmful level of exhaled carbon dioxide.

It would be desirable to implement a foldable breathe-through sleep structure.

SUMMARY

The invention encompasses an aspect concerning a foldable breathe-through mattress comprising a foldable base frame, a top frame assembly, a flexible mat, and a topper. The top frame assembly may comprise a first arm, a second arm, a first frame clip, and a second frame clip. The first and second frame clips are generally attachable to the foldable base frame and the first and the second arms are generally attached by hinges to the first and the second frame clips. The flexible mat may be removably attached to a bottom of the foldable base frame. The topper may be removably attached to the first and the second arms of the top frame assembly.

The invention also encompasses an aspect concerning a method of supporting a person comprising (a) opening a foldable base frame, (b) removably attaching a flexible mat to a bottom of the foldable base frame, (c) attaching a top frame assembly to a top of the foldable base frame, where (i) the top frame assembly comprises a first arm, a second arm, a first frame clip, and a second frame clip, (ii) the first and second frame clips are attached to the foldable base frame and the first and the second arms are attached by hinges to the first and the second frame clips, (d) attaching a topper to the first and the second arms, (e) moving the arms into a closed position, and (f) latching the first and the second arms in the closed position to tension the topper.

BRIEF DESCRIPTION OF THE FIGURES

Embodiments of the invention will be apparent from the following detailed description and the appended claims and drawings in which:

DETAILED DESCRIPTION OF THE EMBODIMENTS

Figure 1:
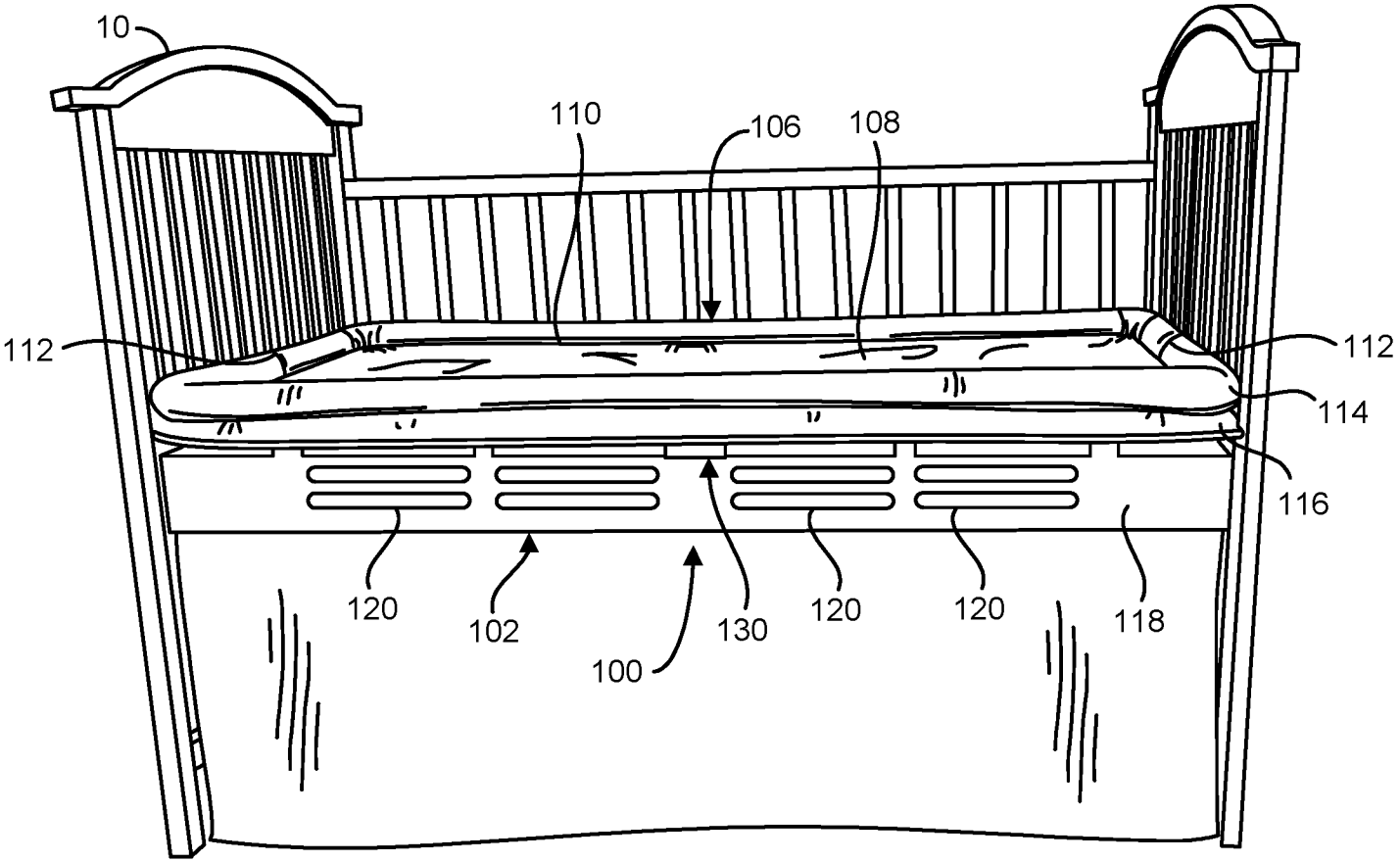
FIG. 1 is a diagram showing a perspective view illustrating a foldable breathe-through mattress in accordance with an embodiment of the invention installed in a crib.

Embodiments of the present invention include providing a foldable breathe-through sleep structure that may (i) provide a breathe-through infant mattress, (ii) be placed in a crib, (iii) be implemented as a stand alone sleep surface, (iv) be folded for easy storage, (v) have a topper and bottom mat that may be removed and machine washed, and/or (vi) be scaled to fit infants, toddlers, and/or adults.

In various embodiments, a foldable breathe-through crib mattress (or sleep surface) may include a topper (or cover), a base frame, and a top frame assembly. The base frame generally comprises two long leg sections and four short leg sections. Ends of the long leg sections and the short leg sections are generally configured to form hinged joints. The long leg sections and the short leg sections are generally connected by the hinged joints, which allows the base frame to be folded for easy storage and transport. The top frame assembly may be removably assembled to the base frame. The top frame assembly generally comprises two arms and two frame clips. Each of the arms is generally attached to the two frame clips by hinges. The frame clips are generally configured to mount the top frame assembly to each side of the base frame at points where two of the short leg sections are connected by a hinged joint. The frame clips are generally configured to fit (wrap) over the hinged joints to lock the hinged joints in an unfolded position. In an example, the frame clips may be attached to an inner surface of the base frame sections. In an example, the frame clips may be attached using knurled thumbscrews for ease of assembly and disassembly. In various embodiments, captive knurled thumbscrews may be used in each of the frame clips to avoid loss and/or avoid a potential choking hazard.

The topper is generally removably attached to the top frame assembly. In various embodiments, the topper may be attached to the two arms of the top frame assembly using two zippers. In an example, the zippers may comprise #10 flat coil heavy duty zippers. In various embodiments, one-half of each of the two zippers may be configured to be entrapped within a respective arm of the top frame assembly. In an example, each of the zipper halves may comprise an open woven channel running a length of the zipper. In another example, material of each zipper half may be folded over and stitched to form a channel running the length of the zipper. In an example, a section of tubing may be slid into the open woven channel of each zipper half to create a bead that allows the zipper halves to be entrapped within the respective arm of the top frame assembly. In an example, each of the arms may comprise (define) an interior space configured to entrap a respective zipper half with a quarter-inch diameter section of polyethylene tubing inserted into the open woven channel of the zipper half. A second half of each of the two zippers may be sewn to a respective side edge of the topper.

In various embodiments, a siliconized mat may be attached to a bottom surface (edge) of the base frame. In an example, the siliconized mat may be attached using nylon push rivets. However, other types of fasteners may be used. In an example, the siliconized mat may be configured such that bodily fluids that pass through the topper are held within a cavity defined by the foldable base frame.

The topper, which replaces a traditional mattress structure, may include a number of layers. In an example where the foldable breathe-through crib mattress (or sleep surface) is employed in a standard crib, the topper may have length and width dimensions of about fifty-one (51) inches by twenty-seven (27) inches (1295.4 millimeters by 685.8 millimeters). In another example, the topper may have length and width dimensions of about fifty-three and one-half (53.5) inches by about thirty (30) inches (1359 millimeters by 762 millimeters). However, other length and width dimensions suitable for bedding used by children may be implemented accordingly to meet design criteria of a particular application.

In an example, the topper may be fabricated using fabric including fluid-wicking yarns or fibers that are warp-knitted in an open-weave fashion. In an example, a knitted mesh including sinusoidal mesh strands extending generally parallel to each other may be used. The strands may be spaced apart from each other and connected to each other via a plurality of threads or a plurality of groups of threads that are spaced apart from each other. In this manner, the strands and threads of the fabric of the topper may cooperate to form a mesh having a plurality of polygonal, circular or oval-shaped openings (or holes).

The fabric used to make the topper may be permeable to fluids, dissipate heat, and/or facilitate airflow. In an example, the topper fabric may include a portion formed from micro-denier fibers. An example of a suitable micro denier fiber would be spun polyester fibers having an average denier of 70 or more. In an example, a suitable fabric for making the topper may include, but is not limited to, a three-dimensional (3D) knit spacer fabric. In some embodiments, the topper may comprise one hundred percent monofilament polyester that may be fire resistant, mildew resistant, and/or resistant to alkaloids and acids. However, other materials and fabrics may be used that allow air to relatively easily and passively flow through the topper and are capable of performing the functionality described herein. The topper may also include a spacer fabric or a breathable polyester netting layer that may be substantially inelastic and dimensionally stable such that the netting has little or no stretch when placed under tension loads. The netting (or spacer fabric) may be sewn across a plane of an underside of the topper to provide stability and/or to increase firmness.

The topper fabric generally allows substantially free flow of air up and down through the topper. Air passage and circulation is generally aided by the cavity defined by the base frame and a number of openings (or slots) in sidewalls of the base frame. In an example, the structure and function of the foldable breathe-through mattress generally allows an infant to lie face-down on the topper and not re-breath a potentially harmful level of carbon dioxide and/or germs. The fabric of the topper generally wicks liquids and moisture away from an outer surface of the topper, providing numerous health, safety and hygienic benefits over conventional mattresses. The substantially free flow of air also allows the infant to maintain a relatively consistent body temperature compared to conventional mattresses or plastic protective sheets. Furthermore, due to the ease of installation and removability of the topper from the top frame assembly, the topper of the foldable breathe-through mattress may be quickly and easily removed and washed in a conventional washing machine to remove stains, bacteria, and other material.

In an example embodiment, the foldable base frame may comprise two (2) long leg sections and four (4) short leg sections. In various embodiments, the long leg sections and the short leg sections may be assembled together using pins to form hinges that allow the base frame to fold. In an example, the ends of the long leg sections and the short leg sections may be configured to form the hinges with an offset pivot axis to allow the sections to fold flat against each other.

In an example, the pins may be implemented using one-eighth inch diameter stainless steel rods. In various embodiments, the foldable base frame generally has rounded corners and edges to prevent injury. In an example, the ends of the long leg sections and the short leg sections are configured to rotate relative to each other such that a possibility of being pinched by the hinges is reduced. In various embodiments, the base frame may be formed from various materials including, but not limited to, aluminum, steel, or any other metallic material, wood, polymeric, and/or composite material having sufficient strength and rigidity. In an example, the base frame may be manufactured using high-density polyethylene (HDPE). In an example, the base frame may be manufactured using a blow molding process. In another example, the base frame may be manufactured using an injection molding process. However, other types of manufacturing processes may be used.

In various embodiments, the arms of the top frame assembly generally have rounded corners and edges to prevent injury. In various embodiments, the arms of the top frame assembly may be formed from various materials including, but not limited to, aluminum, steel, or any other metallic material, wood, polymeric, and/or composite material having sufficient strength and rigidity. In an example, the arms of the top frame assembly may be manufactured using high-density polyethylene (HDPE). In an example, the arms of the top frame assembly may be manufactured using a blow molding process. In another example, the arms of the top frame assembly may be manufactured using an injection molding process. However, other types of manufacturing processes may be used.

In various embodiments, the foldable breathe-through crib mattress (or sleep surface) may be suitable for use by babies, infants, toddlers, and/or young children (hereinafter collectively referred to as "children"). In some embodiments, the foldable breathe-through crib mattress (or sleep surface) may be mounted or retrofitted to a traditional crib. In still other embodiments, the foldable breathe-through crib mattress (or sleep surface) may be a stand-alone unit that may be placed on a floor or other surface. The foldable breathe-through crib mattress (or sleep surface) generally provides safe, hygienic, and comfortable bedding for children. In contrast to conventional crib mattresses, the fabric portions of the foldable breathe-through crib mattress (or sleep surface) may be easily removed for washing.

With reference to FIGS. 1-8, a foldable breathe-through crib mattress (or sleep surface) 100 is provided that may include a foldable base frame 102, a top frame assembly 104, and a topper (or cover) 106. In various embodiments, the foldable base frame 102 may support the topper 106 mounted on the top frame assembly 104. In an example embodiment, the foldable base frame 102 may comprise two (2) long leg sections 118, two (2) right-hand short leg sections 122, and two (2) left-hand short leg sections 124. In an example, the long leg sections 118, the right-hand short leg sections 122, and the left-hand short leg sections 124 may include a plurality of openings 120 which allow a free flow of air. In various embodiments, the long leg sections 118, the right-hand short leg sections 122, and left-hand short leg sections 124 may be assembled together using pins 154 to form hinges that allow the foldable base frame 102 to fold. In an example, the hinge pins 154 may be implemented using one-eighth inch diameter stainless steel rods. In an example, a flexible mat 117 may be attached to a bottom surface of the long leg sections 118, the right-hand short leg sections 122, and the left-hand short leg sections 124. In an example, the flexible mat 117 may be connected to the long leg sections 118, the right-hand short leg sections 122, and the left-hand short leg sections 124 using nylon rivets that are press-fit into holes in the bottom surface of the long leg sections 118, the right-hand leg sections 122, and the left-hand short leg sections 124. In various embodiments, the foldable breathe-through crib mattress (or sleep surface) 100 may be suitable for use by babies, infants, toddlers, and/or young children (hereinafter collectively referred to as "children").

Referring to FIG. 1, a perspective view is shown illustrating a foldable breathe-through crib mattress (or sleep surface) 100 in accordance with an embodiment of the invention installed in a crib 10. In an example, the foldable breathe-through crib mattress (or sleep surface) 100 may be mounted in or retrofitted to a standard crib 10. In an example, the foldable breathe-through crib mattress (or sleep surface) 100 may comprise a foldable base frame 102, a top frame assembly 104, and a topper (or cover) 106. In various embodiments, the foldable base frame 102 may support the topper 106 mounted on the top frame assembly 104. In various embodiments, the foldable base frame 102 may comprise latch members 130 configured to lock arms of the top frame assembly 104 to the foldable base frame 102 during use.

In various embodiments, the topper 106, which replaces a traditional mattress structure, according to the teachings of the present disclosure, may include an upper layer 108, a bumper 114, and zipper halves 116. The bumper 114 may be an elongated member extending around a perimeter 110 of the topper 106. The bumper 114 may be sized and positioned relative to the topper 106 to provide a barrier and cushion over the top frame assembly 104 to protect a child lying in the foldable breathe-through crib mattress (or sleep surface) 100. In an example, the bumper 114 may include a fabric outer layer encasing a filler material to form a generally circular cross section. In an example, the bumper 114 may include, but is not limited to, a diameter of about one and one-half (1.5) inches to two and one-half (2.5) inches (38-64 millimeters).

In an example, the bumper 114 may be formed from a breathable spacer fabric and may be connected to the perimeter 110 of the topper 106 at a stitched seam. The filler material may be a resiliently compressible material. One example includes a six-layer polyester filler material manufactured by Petco Sackner and sold under the product designation jute braided polyester. However, other suitable cushioning material may be used. The bumper 114 may also include a break or slit 112 at opposing ends of the topper 106 to facilitate installation and removal of the topper 106 from the top frame assembly 104. It will be appreciated that the structure of the bumper 114 is not limited to the structure described above and may include alternatively configured dimensions and/or materials.

In an example, the zipper halves 116 may extend downward (relative to the view shown in FIG. 1) on each side of the topper from the stitched seam connecting the upper layer 108 and the bumper 114. The zipper halves 116 are generally configured to engage an entrapped zipper half 162 in each arm 160 of the top frame assembly 104.

Figure 2:
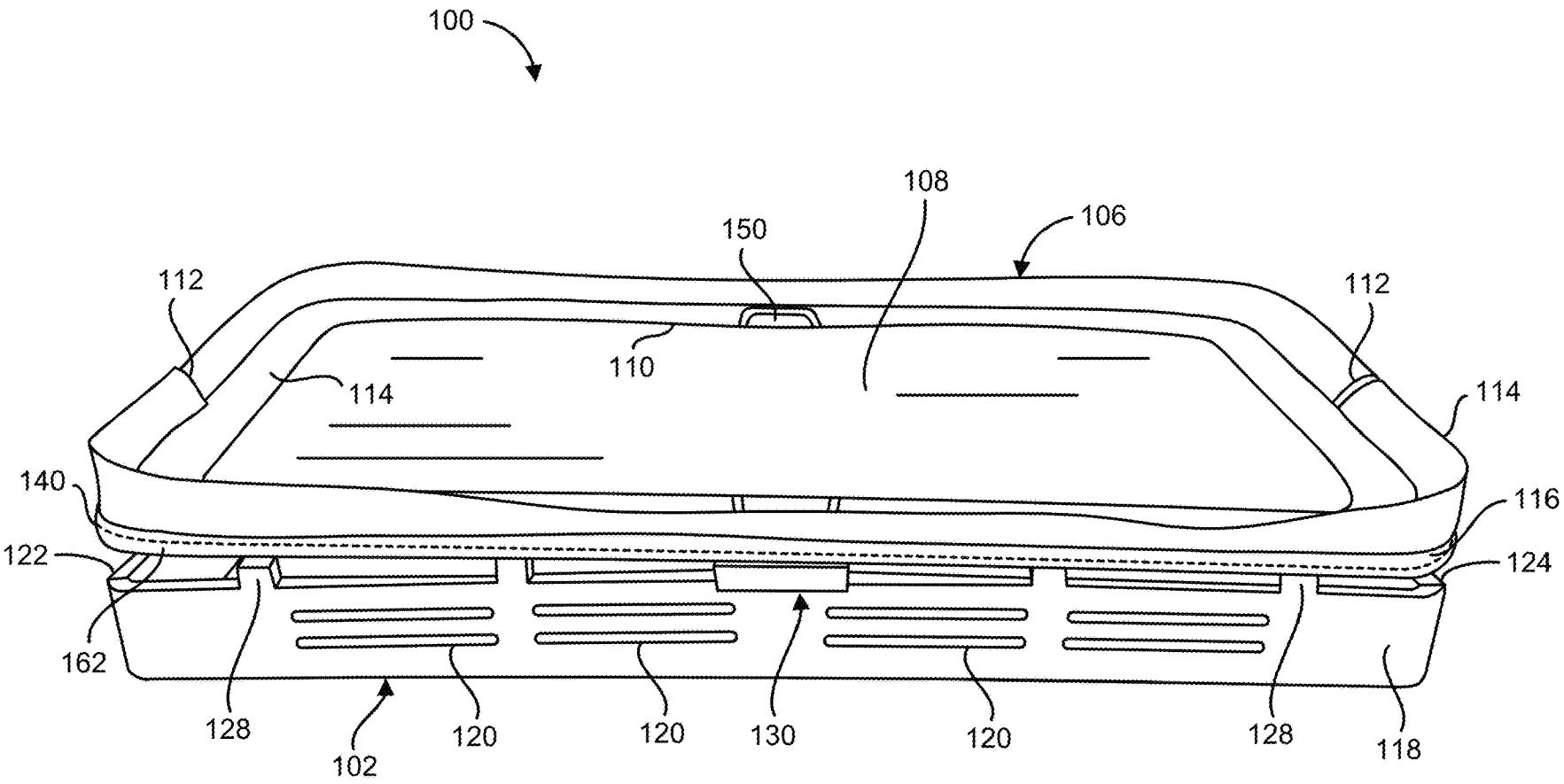
FIG. 2 is a diagram showing a perspective view illustrating the foldable breathe-through mattress with a topper in accordance with an embodiment of the invention.

Referring to FIG. 2, a perspective view is shown illustrating the foldable breathe-through mattress with a topper in accordance with an embodiment of the invention. In some embodiments, the foldable breathe-through crib mattress (or sleep surface) 100 may be implemented (configured) as a stand-alone unit that may be placed on a floor or other surface. As will be subsequently described, the foldable breathe-through crib mattress (or sleep surface) 100 generally provides safe, hygienic and comfortable bedding for children.

In various embodiments, the topper 106, which replaces a traditional mattress structure, according to the teachings of the present disclosure, may include an upper layer 108, a bumper 114, and a zipper half 116. When employed in a standard crib 10, the topper 106 may have length and width dimensions, for example, of about fifty-one (51) by twenty-seven (27) inches (1295.4 millimeters by 685.8 millimeters). In another example configuration, the topper 106 may have length and width dimensions, for example, of about fifty-three and one-half (53.5) inches by about thirty (30) inches (1359 millimeters by 762 millimeters). It will be appreciated that the topper may be implemented with other length and width dimensions suitable for a sleep surface used by children.

The upper layer 108 may be formed from a "spacer" fabric including fluid-wicking yarns or fibers that are warp-knitted in an open-weave fashion. The upper layer 108 may be a knitted mesh including sinusoidal mesh strands extending generally parallel to each other. The strands may be spaced apart from each other and connected to each other via a plurality of threads or a plurality of groups of threads that are spaced apart from each other. In this manner, the strands and threads of the fabric of the upper layer 108 may cooperate to form a mesh having a plurality of polygonal, circular, or oval-shaped holes. The upper layer 108 is generally permeable to fluids, dissipates heat, and facilitates airflow there-through. In an example, the spacer fabric may include a top panel in contact with the child, formed from micro-denier fibers, a bottom panel which supports the top panel and a "spacer" which sticks the top and bottom panels together to form a three dimensional fabric. An example of a suitable micro denier fiber would be spun polyester fibers having an average denier of 70 or more. Examples of suitable "spacer" fabric include a three-dimensional knit spacer fabric marketed under the brand name $D^3$ manufactured by Gehring Textiles, Inc. in Garden City, N. Y. Another suitable material for the upper layer 108 is marketed under the name 3MESH manufactured by Muller Textile located in Germany. In some embodiments, the upper layer 108 may be one hundred percent monofilament polyester that may be fire resistant, mildew resistant, and resistant to alkaloids and acids. Other materials and fabrics may be used that allow air to relatively easily and passively flow through the upper layer 108 and are capable of performing the functionality described herein.

The bumper 114 may be an elongated member extending around a perimeter 110 of the topper 106, as shown in FIGS. 1 and 2. The bumper 114 may be sized and positioned relative to the topper 106 to provide a barrier and cushion over the top frame assembly 104 to protect a child lying in the foldable breathe-through crib mattress (or sleep surface) 100. The bumper 114 may include a fabric outer layer encasing a filler material to form a generally circular cross section. By way of non-limiting example, the bumper 114 may include a diameter of about one and one-half (1.5) inches to two and one-half (2.5) inches (38-64 millimeters). The bumper 114 may be formed from the breathable spacer fabric described above, for example, and may be connected to the topper 106 at the stitched seam. The filler material may be a resiliently compressible material. One example includes a six-layer polyester filler material manufactured by Petco Sackner and sold under the product designation n jute braided polyester. However, other suitable cushioning material may be used. The bumper 114 may also include a break or slit 112 at opposing ends of the topper 106 to facilitate installation and removal of the topper 106 from the top frame assembly 104. It will be appreciated that the structure of the bumper 114 is not limited to the structure described above, and may include alternatively configured dimensions and/or materials.

The zipper halves 116 may extend downward (relative to the view shown in FIG. 1) from the stitched seam connecting the upper layer 108 and the bumper 114. The zipper halves 116 are generally configured to engage entrapped zipper halves 162 in the arms 160 of the top frame assembly 104, forming a zipper connection between the topper 106 and the top frame assembly 104.

In various embodiments, the foldable base frame 102 may support the topper 106 mounted on the top frame assembly 104. In an example embodiment, the foldable base frame 102 may comprise two (2) long leg sections 118, two (2) right-hand short leg sections 122, and two (2) left-hand short leg sections 124. In an example, the long leg sections 118, the right-hand short leg sections 122, and the left-hand short leg sections 124 may include a plurality of openings 120 which allow a free flow of air. In an example, the long leg sections 118 may comprise a number of risers 128. The risers 128 generally provide support for the top frame assembly 104 while allowing access to lift the arms of the top frame assembly 104 (e.g., for access to an interior cavity of the foldable breathe-through mattress, to remove the topper 106 from the top frame assembly 104, etc.). In some embodiments, the right-hand short leg sections 122 and the left-hand short leg sections 124 may also be implemented with one or more risers 128. In various embodiments, the foldable base frame 102 may comprise latch members 130 configured to lock the arms of the top frame assembly 104 against the risers 128 of the foldable base frame 102 during use.

The topper 106 may include a pair of panels (or flaps) 150. The panels 150 may cover and allow access to latch mechanisms of the first and the second arms of the top frame assembly 104. The latch mechanisms may be configured to securely retain each of the arms of the top frame assembly 104 in a closed position (e.g., against the risers 128 of the foldable base frame 102). In an example, the flaps 150 may be stitched to the topper 106 along one edge. In an example, the flaps 150 may be held closed over the latch mechanisms of the first and the second arms of the top frame assembly 104 by hook and loop type fasteners attached to remaining edges of the flaps 150.

Figure 3:
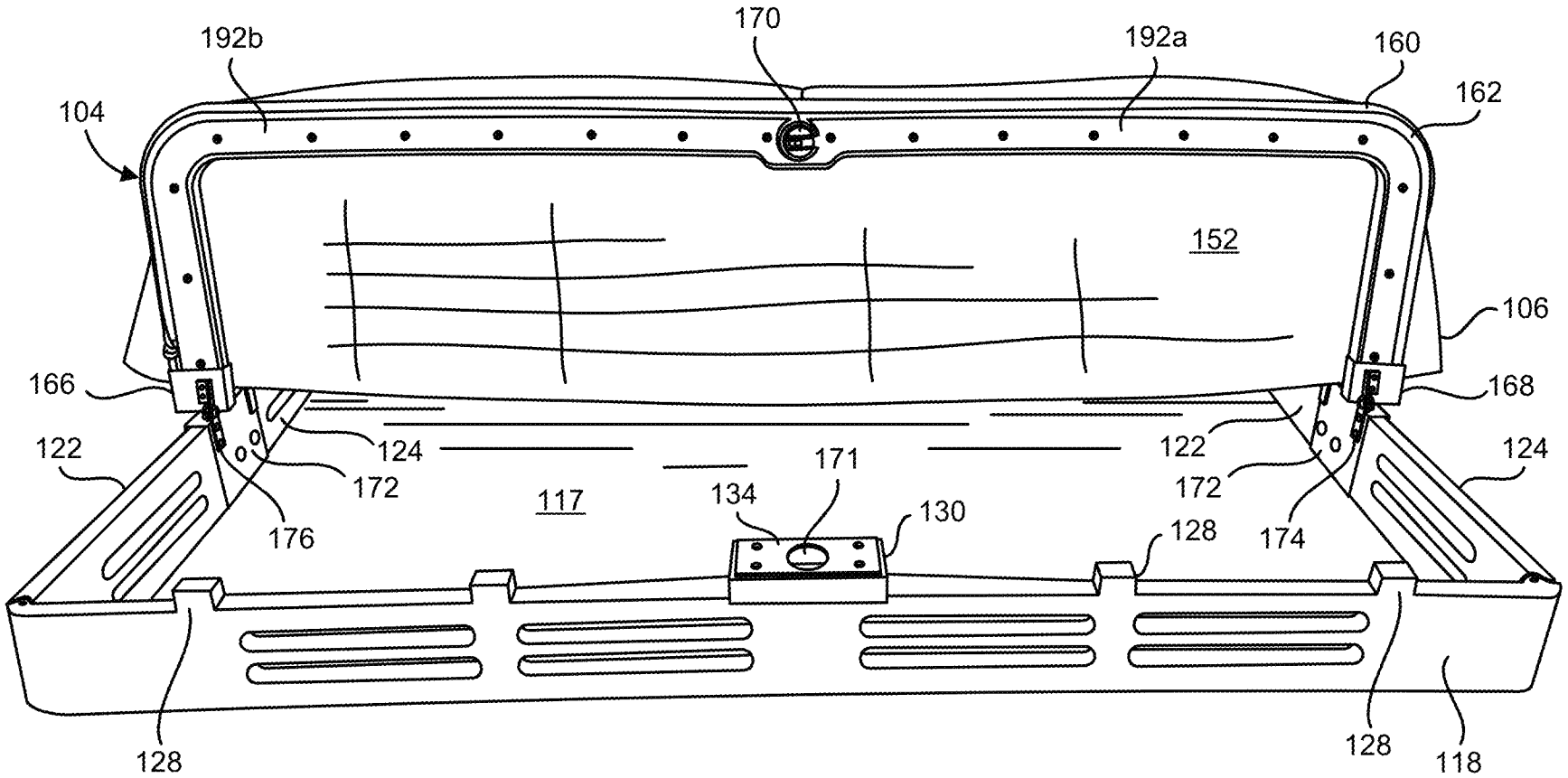
FIG. 3 is a diagram showing a perspective view FIG. illustrating the foldable breathe-through mattress of FIG. 2 having a first arm of a top frame assembly in an open position.

Referring to FIG. 3, a diagram is shown illustrating a perspective view of the foldable breathe-through crib mattress of FIG. 2 having a first arm 160 of the top frame assembly 104 in an open position and a second arm 160 of the top frame assembly 104 in a locked position (not visible). With the first arm 160 of the top frame assembly 104 in the open position, an interior cavity of the foldable breathe-through crib mattress 100 is visible showing a flexible bottom mat 117 forming a bottom of the interior cavity of the foldable base frame 102. In an example, the flexible bottom mat 117 may be attached to a bottom surface of the long leg sections 118, the right-hand short leg sections 122, and the left-hand short leg sections 124 of the foldable base frame 102. In an example, the flexible bottom mat 117 may be connected to the long leg sections 118, the right-hand short leg sections 122, and the left-hand short leg sections 124 using nylon rivets that are press-fit into holes in the bottom surface of the long leg sections 118, the right-hand leg sections 122, and the left-hand short leg sections 124.

In the particular embodiment shown in FIGS. 1-8, the long leg sections 118, the right-hand short leg sections 122, and the left-hand short leg sections 124 of the foldable base frame 102 provide four vertically-extending sidewalls that cooperate with the bottom mat 117 to form a generally rectangular box. In various embodiments, the top frame assembly 104 and the topper 106 may be mounted to topsides of the long leg sections 118, the right-hand short leg sections 122, and the left-hand short leg sections 124 such that the topper 106 cooperates with the long leg sections 118, the right-hand short leg sections 122, the left-hand short leg sections 124, and the bottom mat 117 to form an enclosed cavity.

In various embodiments, the topper 106, which replaces a traditional mattress structure, according to the teachings of the present disclosure, may also include a lower (or bottom) layer 152. The lower layer 152 may be formed, for example, from a spacer fabric or a breathable polyester netting that may be substantially inelastic and dimensionally stable such that the lower layer 152 has little or no stretch when placed under tension loads. The top layer 108, the bumper 114, the zipper halves 116, and the lower layer 152 may be joined together by a stitched seam. The netting (or spacer fabric) of the lower layer 152 may be further sewn across a plane of an underside of the topper 106 to provide stability and/or to increase firmness of the topper 106.

In various embodiments, the long leg sections 118, the right-hand short leg sections 122, and the left-hand short leg sections 124 may include a plurality of openings 120 extending there-through in communication with the enclosed cavity. The openings 120 may be vertically spaced apart from the flexible bottom mat 117. While the openings 120 are illustrated as being generally elongated slots, the openings 120 may be formed in any shape or manner to facilitate aesthetic appeal and airflow into and out of the enclosed cavity.

The top frame assembly 104 may function as a tensioning device. The top frame assembly 104 may include first and second arms 160. In various embodiments, the first and second arms 160 may be implemented having a generally U-shaped structure. In various embodiments, the first and second arms 160 may be implemented having generally rounded corners and edges. In various embodiments, the first and second arms 160 may be removably attached to the foldable base frame 102 by frame clip assemblies 172. In an example, the frame clip assemblies 172 may be removably attached to the right-hand short leg sections 122 and the left-hand short leg sections 124. Corresponding distal ends 166 and 168 of the first and second arms 160 are generally connected to each other and to the foldable base frame 102 via hinges 174 and 176 of the frame clip assemblies 172. In an example, the first and second arms 160 may be formed from tubular aluminum or steel, for example, or any other metallic, wooden, polymeric or composite material having sufficient strength and rigidity. In another example, the first and second arms 160 may be formed from high-density polyethylene (HDPE) using at least one of a blow molding process and an injection molding process.

Figure 7:
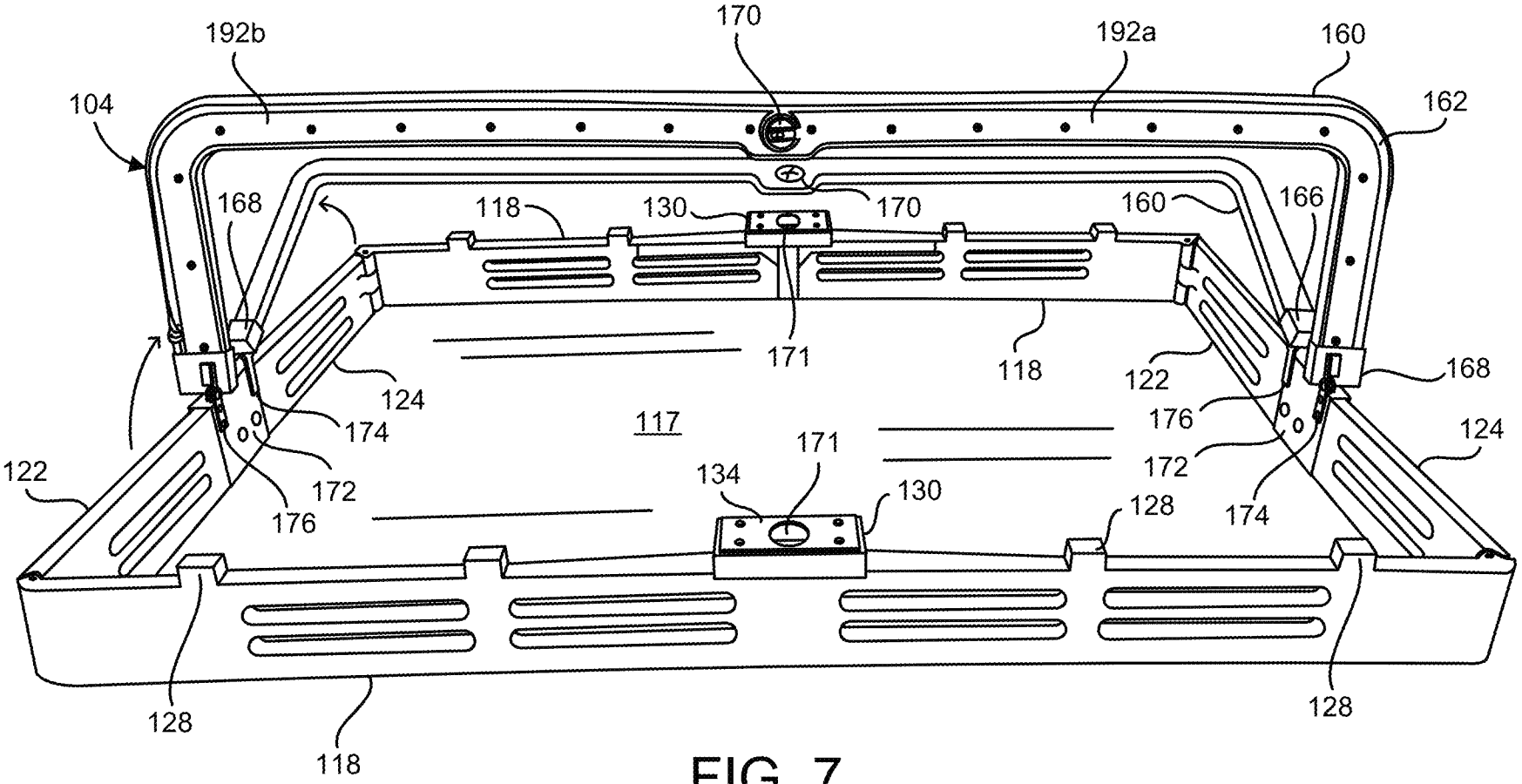
FIG. 7 is a diagram showing a perspective view of the base frame of the foldable breathe-through mattress of FIG. 2 illustrating the first and second arms of the top frame assembly moving between the closed position and the open position.

The hinges 174 and 176 of the frame clip assemblies 172 generally allow the first and second arms 160 to pivot between a closed (or locked) position and an open (or unlocked) position (e.g., illustrated in FIG. 7). The first and second arms 160 may pivot relative to each other and/or the foldable base frame 102 simultaneously or independently from each other. The hinges 174 and 176 may include springs or other biasing members to urge the first and second arms 160 toward the open positions.

The first and second arms 160 may comprise latch mechanisms to securely retain each of the first and the second arms 160 in the closed positions (e.g., against the risers 128 of the foldable base frame 102). In an example, each of the latch mechanisms may include a male member 170 and a female member 130. The male members 170 may be mounted to the first and second arms 160. When the first and the second arms 160 are in the closed position, the male members 170 may protrude through openings 171 in the female members 130. The female members 130 may be mounted to the two long leg sections 118. The two long leg sections 118 may be configured to facilitate attachment of the female members 130. In an example, a spacer 134 may be attached to a top surface of the female members 130. The spacer 134 may be configured to ensure a tight, secure fit between the female members 130 and a bottom of the arms 160. The spacer 134 may also be configured to prevent movement of the arms 160 at the latch location due to movement on the surface of the topper 106. The male members 170 of the latch mechanisms may be spring-loaded such that the male members 170 may be pressed or snapped into engagement with the female members 130. A user may release the engagement between the male members 170 and the female members 130 by rotating a knob of the male members 170.

In an example, the knob of the male members 170 may be configured as push-to-lock, push-to-release. When pushed to lock, the knob generally becomes latched in a position that is flush with a top surface of the respective arm 160. When pushed to release, the knob is generally configured to pop up to allow the knob to be rotated to unlatch the male member 170 from the female member 130. It will be appreciated that the latch mechanisms could be other types of latch, clasp, or closure that selectively allow and prevent movement of the first and/or second arms 160 relative to the foldable base frame 102.

Figure 4:
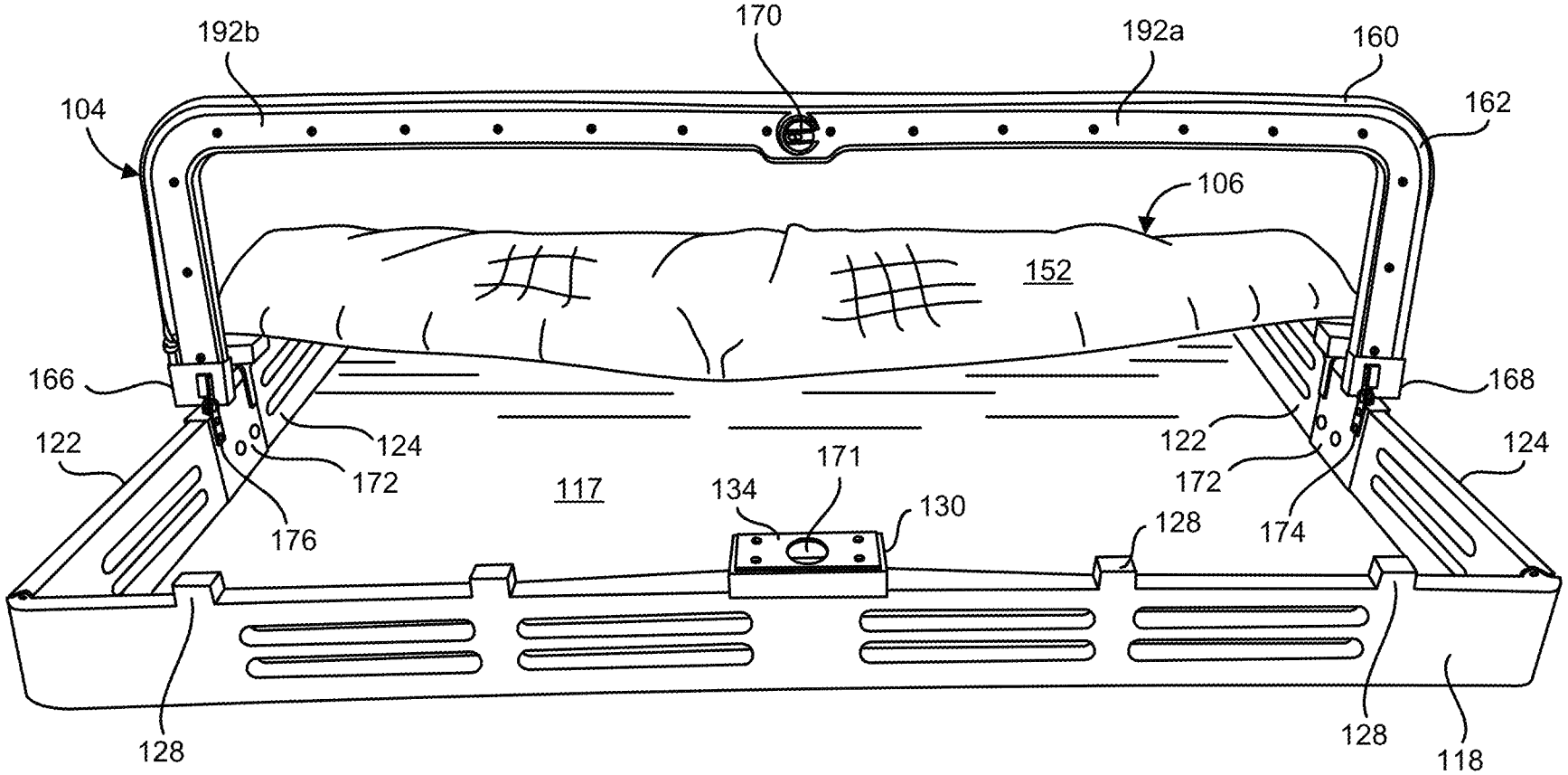
FIG. 4 is a diagram showing a perspective view illustrating the foldable breathe-through mattress of FIG. 3 having a first portion of the topper unzipped from the first arm of the top frame assembly in the open position.

Referring to FIG. 4, a diagram is shown illustrating a perspective view of the foldable breathe-through mattress 100 of FIG. 3 having a first portion of the topper 106 unzipped from the first arm 160 of the top frame assembly 104 in the open position. When one or both of the arms 160 of the top frame assembly 104 are in the open position, tension on the topper 106 is generally released and the topper 106 may be removed easily by unzipping the zipper halves 116 of the topper 106 from zipper halves 162 of the arms 160.

Figure 5:
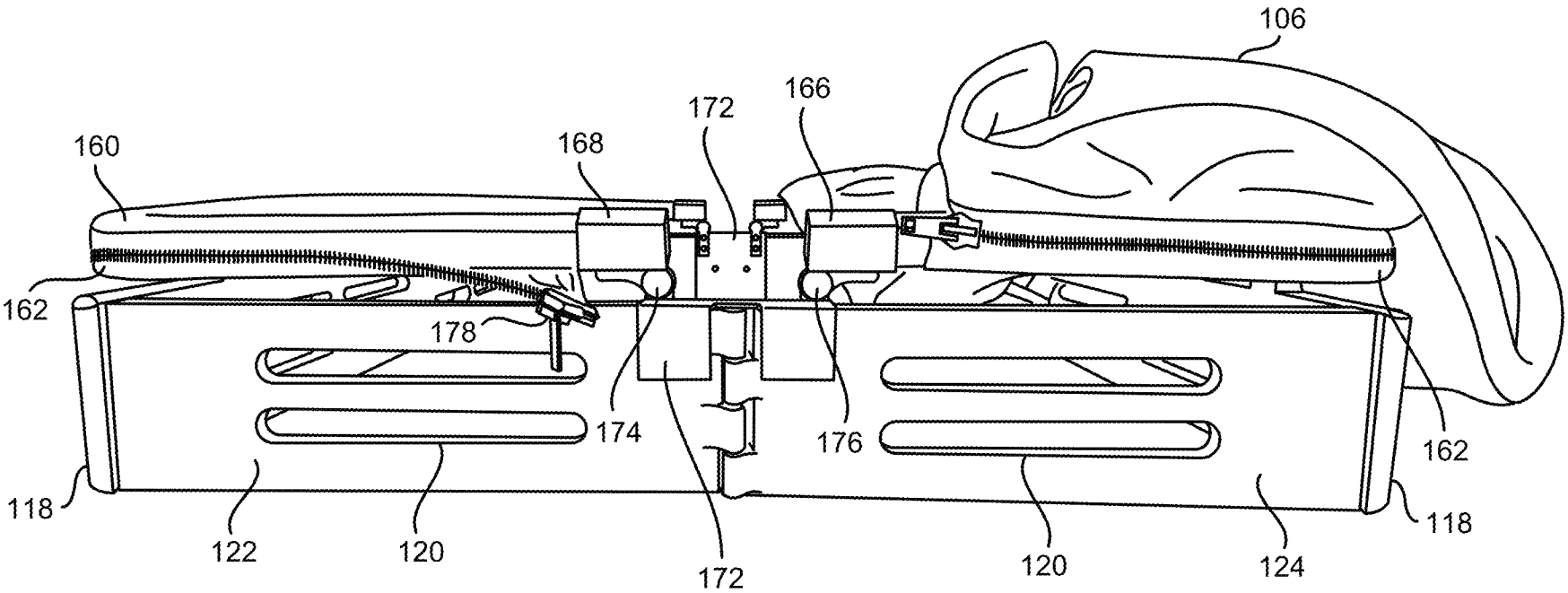
FIG. 5 is a diagram illustrating an end view of the foldable breathe-through mattress showing the first portion of the topper unzipped from the first arm of the top frame assembly and a second portion of the topper zipped onto a second arm of the top frame assembly.

Referring to FIG. 5, a diagram is shown illustrating an end view of the foldable breathe-through mattress showing the first portion of the topper unzipped from the first arm of the top frame assembly and a second portion of the topper zipped onto the second arm of the top frame assembly. In various embodiments, the zipper halves 162 that are attached to the arms 160 generally include a slider 178. In various embodiments, the frame clips 172 are configured to wrap over the foldable base frame 102 and around a hinged connection in the foldable base frame 102, locking the foldable base frame 102 in an unfolded position. In various embodiments, the frame clips 172 wrap over the ends of the right-hand short leg sections 122 and the left-hand short leg sections that are hinged together. In an example, the frame clips 172 have a first tab that makes contact with an exterior surface of the right-hand short leg sections 122 and a second tab that makes contact with an exterior surface of the left-hand short leg sections 124. When the frame clips 172 are attached, the hinge between the ends of the right-hand short leg sections 122 and the left-hand short leg sections 124 is generally located in a gap between the first tab and the second tab.

Figure 6:
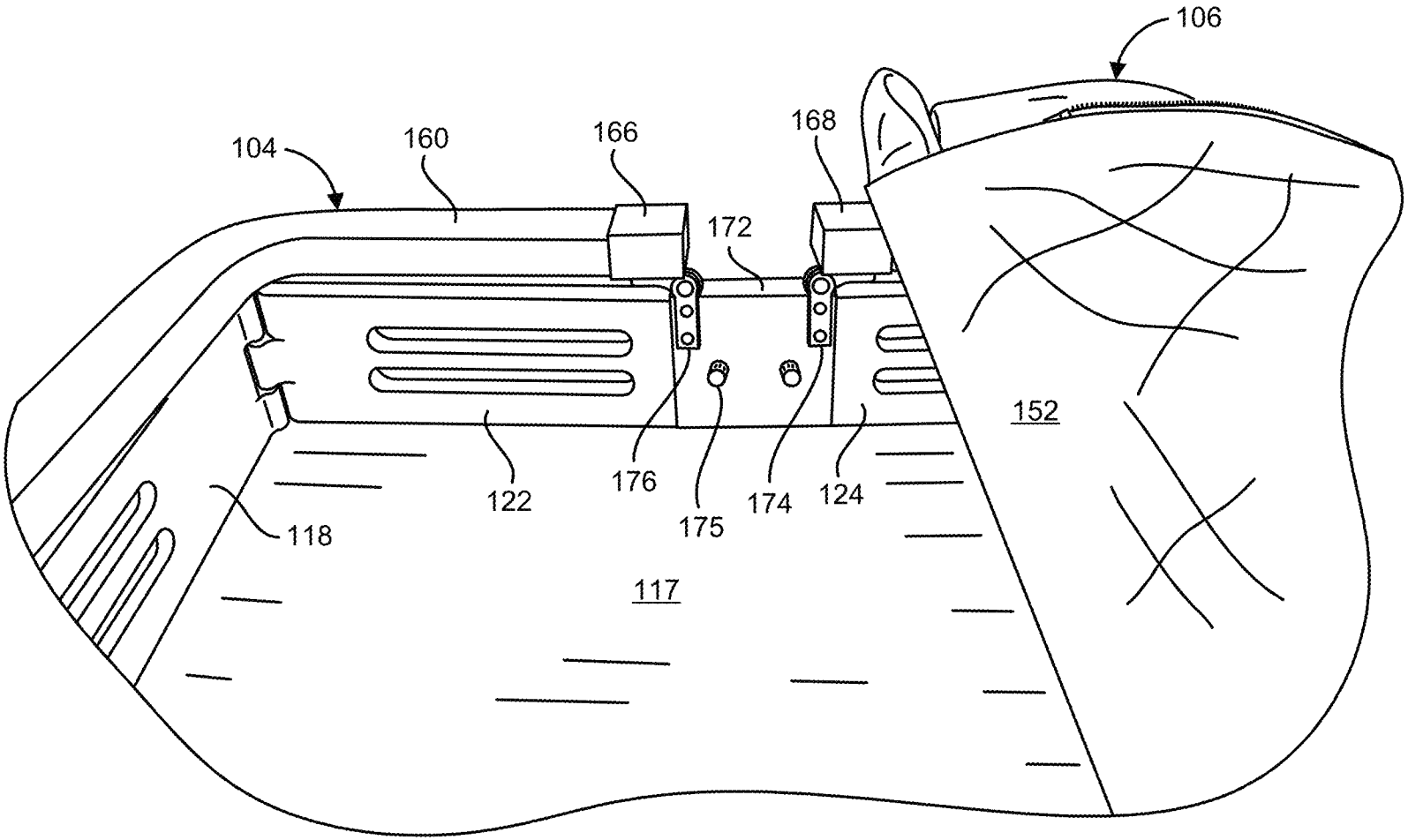
FIG. 6 is a diagram illustrating a frame clip and hinges of the top frame assembly attaching the arms of the top frame assembly to the base frame of the foldable breathe-through mattress of FIG. 2.

Referring to FIG. 6, a diagram is shown illustrating the frame clip 172 and hinges 174 and 176 of the top frame assembly 104 attaching the arms 160 of the top frame assembly 104 to each other and the foldable base frame 102 of the foldable breathe-through mattress of FIGS. 1 and 2. In various embodiments, the frame clips 172 are configured to be attached to an interior surface of the base frame 102. In various embodiments, the frame clips 172 wrap over the ends of the right-hand short leg sections 122 and the left-hand short leg sections 124 that are hinged together. In an example, the frame clips 172 may be attached to an inner surface of the right-hand short leg sections 122 and the left-hand short leg sections 124. In an example, the frame clips 172 may be attached using knurled thumbscrews 175 for ease of assembly and disassembly. In various embodiments, the knurled thumbscrews 175 may be captured knurled thumbscrews (e.g., not removable from the frame clips 172) to avoid loss and/or avoid a potential choking hazard. In an example, the frame clips 172 may be formed from mild steel. In an example, the frame clips 172 may be painted (e.g., powder coated, etc.) to blend in with the foldable base frame 102.

Referring to FIG. 7, a diagram is shown illustrating a perspective view of a base frame of the foldable breathe-through mattress of FIG. 1 with the topper 106 removed and the top frame assembly 104 moving between the closed and the open positions. In various embodiments, the top frame assembly 104 may function as a tensioning device. The top frame assembly 104 may include first and second arms 160. In various embodiments, the first and second arms 160 may be implemented having a generally U-shaped structure. In various embodiments, the first and second arms 160 may be implemented having generally rounded corners and edges (e.g., to prevent injury). In various embodiments, the first and second arms may be removably attached to the foldable base frame 102 by frame clip assemblies 172. In an example, the frame clip assemblies 172 may be removably attached to the right-hand short leg sections 122 and the left-hand short leg sections 124. Corresponding distal ends 166 and 168 of the first and second arms are generally connected to each other and to the foldable base frame 102 via hinges 174 and 176 of the frame clip assemblies 172. In an example, the first and second arms 160 may be formed from tubular aluminum or steel, for example, or any other metallic, wooden, polymeric or composite material having sufficient strength and rigidity. In another example, the first and second arms 160 may be formed from high-density polyethylene (HDPE) using at least one of a blow molding process and an injection molding process.

The hinges 174 and 176 of the frame clip assemblies 172 generally allow the first and second arms 160 to pivot between a closed (or locked) position and an open (or unlocked) position. The first and second arms 160 may pivot relative to each other and/or the foldable base frame 102 simultaneously or independently from each other. In an example, the hinges 174 and 176 may be implemented as torque hinges. The hinges 174 and 176 may include springs or other biasing members to urge the first and second arms 160 toward the open positions. The first and second arms 160 may comprise latch mechanisms to securely retain each of the first and the second arms 160 in the closed positions.

In an example, the first and second arms 160 may start in the open positions when attaching the topper 106 to the first and the second arms 160. In an example, a first side of the topper 106 may be zipped onto the first arm 160, then a second side of the topper 106 may be zipped onto the second arm 160. With the topper attached to the first and the second arms 160, the first arm 160 may be moved into the closed position and latched. Then the second arm 160 may be moved into the closed position and latched. As the second arm 160 is moved into the closed position, the topper 106 is tensioned. When the second arm 160 is latched, the topper 160 is generally locked in the tensioned state.

Figure 8:
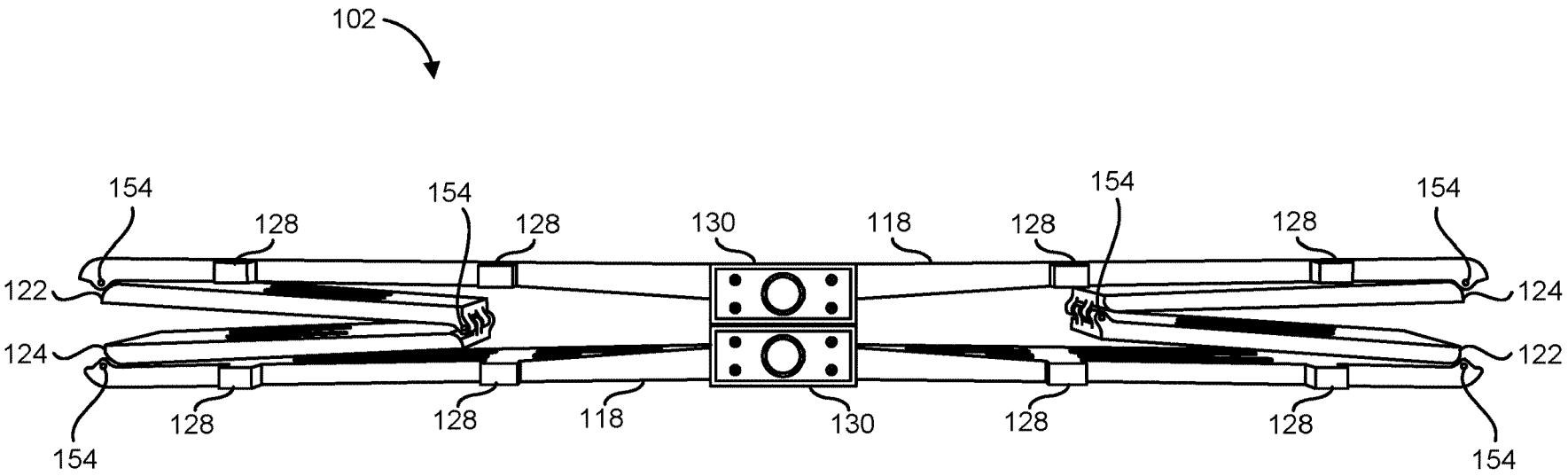
FIG. 8 is a diagram illustrating a top view of the base frame of the foldable breathe-through mattress in a folded position.

Referring to FIG. 8, a diagram is shown illustrating a top view of the base frame of the foldable breathe-through mattress in a folded position. In various embodiments, the long leg sections 118, the right-hand short leg sections 122, and left-hand short leg sections 124 may be assembled together using pins 154 to form hinges that allow the foldable base frame 102 to fold compactly. In an example, the hinge pins 154 may be implemented using one-eighth inch diameter stainless steel rods. In an example, the ends of the long leg sections and the short leg sections may be configured to form the hinges with an offset pivot axis to allow the sections to fold flat against each other. In various embodiments, the foldable base frame generally has rounded corners and edges to prevent injury. In an example, the ends of the long leg sections and the short leg sections are configured to reduce a possibility of being pinched by the hinges while being rotated relative to each. In various embodiments, the foldable base frame 102 may be formed from various materials including, but not limited to, aluminum, steel, or any other metallic material, wood, polymeric, and/or composite material having sufficient strength and rigidity. In an example, the foldable base frame 102 may be manufactured using high-density polyethylene (HDPE). In an example, the foldable base frame 102 may be manufactured using a blow molding process. In another example, the foldable base frame 102 may be manufactured using an injection molding process.

Figure 9A:
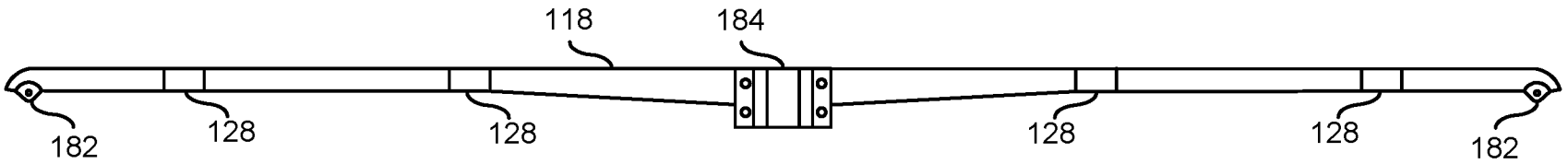
FIGS. 9A-9C are diagrams illustrating a top view, a rear view, and a bottom view, respectively, of a long leg section of the base frame of the foldable breathe-through mattress.
Figure 9B:
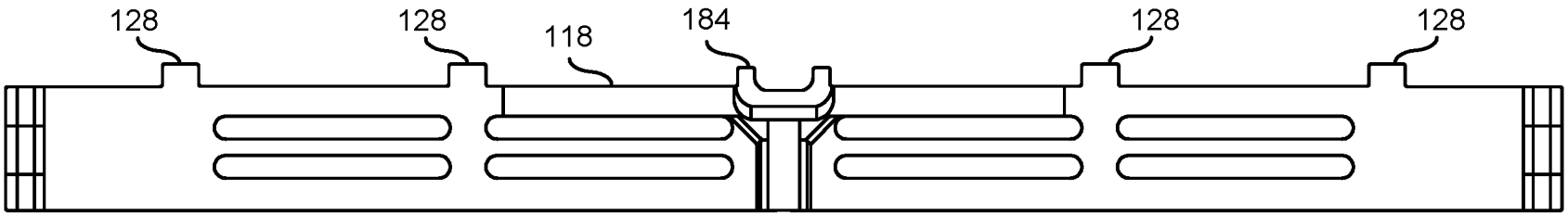
Figure 9C:
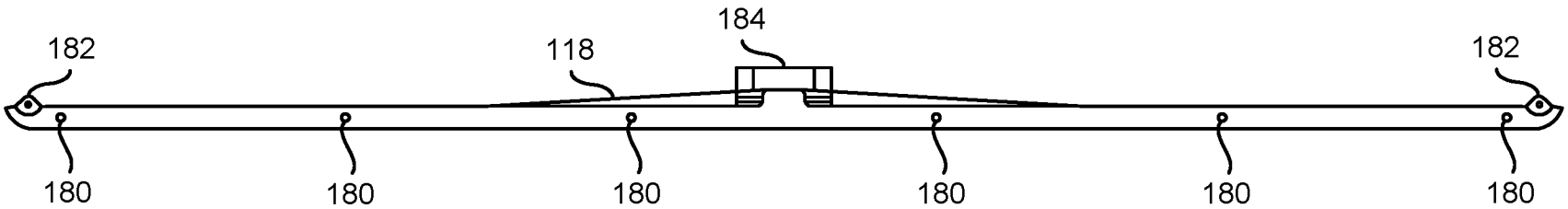

Referring to FIGS. 9A-9C, diagrams are shown illustrating a top view (FIG. 9A), a rear elevation (FIG. 9B), and a bottom view (FIG. 9C), respectively, of a long leg section 118 of the foldable base frame 102 of the foldable breathe-through mattress 100. In an example, the ends of the long leg sections 118 may be configured to form hinges with an offset pivot axis to allow the long leg section to fold flat against the right-hand short leg sections 122, and left-hand short leg sections 124. In an example, the ends of the long leg sections 118 generally define holes (or channels) 182 which are configured to receive the hinge pins 154. In an example, when the hinge pins 154 comprise one-eighth inch diameter stainless steel rods, the holes 182 may be implemented having a diameter of about one-eighth inch. In various embodiments, the foldable base frame 102 generally has rounded corners and edges to prevent injury. In various embodiments, the ends of the long leg sections 118 are generally rounded to form the rounded corners of the foldable base frame 102.

In various embodiments, the long leg sections 118 may be formed from various materials including, but not limited to, aluminum, steel, or any other metallic material, wood, polymeric, and/or composite material having sufficient strength and rigidity. In an example, the long leg sections 118 may be manufactured using high-density polyethylene (HDPE). In an example, the long leg sections 118 may be manufactured using a blow molding process. In another example, the long leg sections 118 may be manufactured using an injection molding process.

In various embodiments, the long leg sections 118 may widen at a center of the long leg sections 118 to provide a mounting feature 184. The mounting feature 184 may be configured to enable the female member 130 of the latching mechanism to be securely attached to the long leg sections 118. In an example, the female member 130 of the latching mechanism may be attached to the mounting feature 184 of the long leg sections 118 using screws (e.g., with or without threaded inserts).

As shown in FIG. 9C, a bottom surface of the long leg sections 118 may define a plurality of holes 180. The holes 180 may be configured to allow the flexible bottom mat 117 to be attached to the long leg sections 118. In an example, the holes 180 may be configured to receive and hold nylon rivets that may pass through holes in the flexible bottom mat 117 and may be press-fit into the holes 180.

Figure 10A:
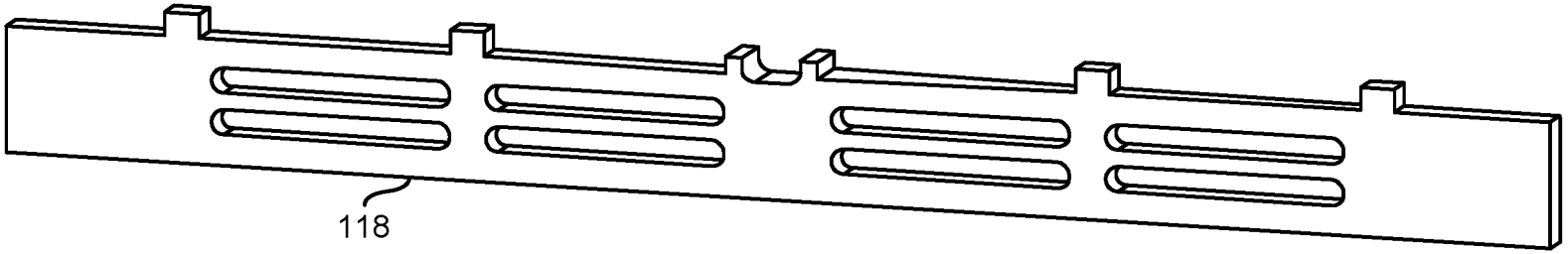
FIGS. 10A and 10B are diagrams illustrating perspective views of a front view and a rear view of the long leg section of the base frame of the foldable breathe-through mattress.
Figure 10B:
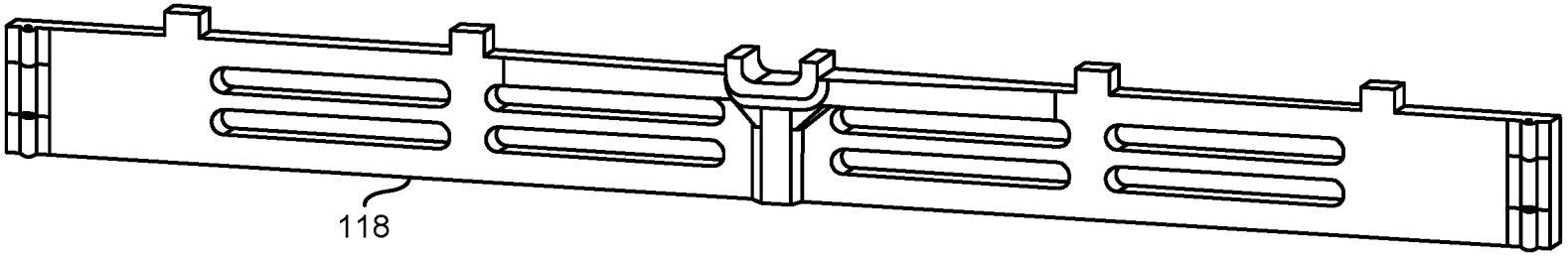

Referring to FIGS. 10A and 10B, diagrams are shown illustrating perspective views of a front (exterior) elevation and a rear (interior) elevation, respectively, of the long leg sections 118 of the foldable base frame 102.

Referring to FIGS. 11A-11F, diagrams are shown illustrating a top view (FIG. 11A), a front (exterior) elevation (FIG. 11B), an end elevation (FIG. 11C), a back (interior) elevation (FIG. 11D), a hinge detail (FIG. 11E), and a cross-sectional view (FIG. 11F) of a right-hand short leg section 122 of the foldable base frame 102. In various embodiments, the right-hand short leg sections 122 may be formed from various materials including, but not limited to, aluminum, steel, or any other metallic material, wood, polymeric, and/or composite material having sufficient strength and rigidity. In an example, the right-hand short leg sections 122 may be manufactured using high-density polyethylene (HDPE). In an example, the right-hand short leg sections 122 may be manufactured using a blow molding process. In another example, the right-hand short leg sections 122 may be manufactured using an injection molding process.

Figure 11A:
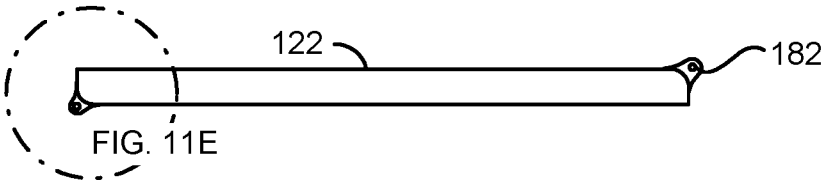
FIGS. 11A-11F are diagrams illustrating views of a first short leg section of the base frame of the foldable breathe-through mattress.
Figure 11B:
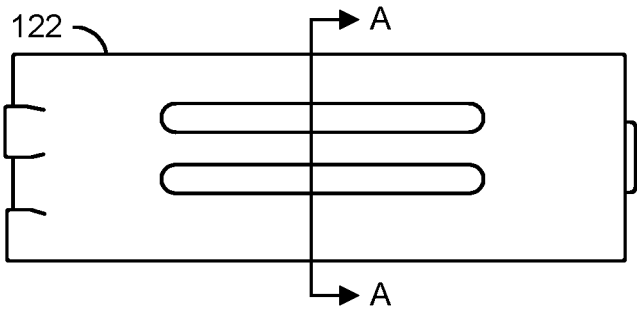
Figure 11C:
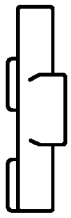
Figure 11D:
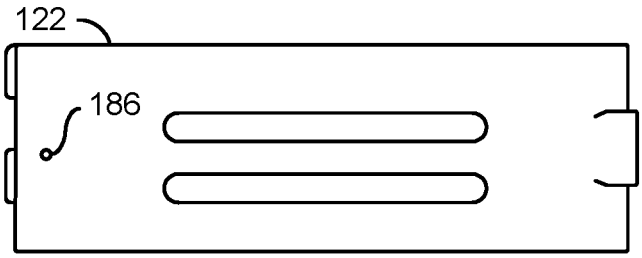
Figure 11E:
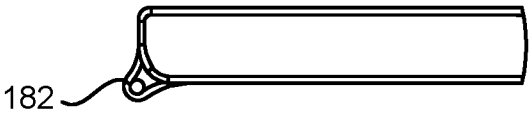
Figure 11F:
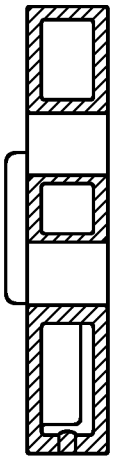

In an example, the ends of the right-hand short leg sections 122 generally comprise hinge features that define holes (or channels) 182 which are configured to receive the hinge pins 154. In an example, when the hinge pins 154 comprise one-eighth inch diameter stainless steel rods, the holes 182 may be implemented having a diameter of about one-eighth inch. In various embodiments, the right-hand short leg sections 122 generally have rounded corners and edges to prevent injury. As shown in FIG. 11D, an interior surface of the right-hand short leg sections 122 generally define a hole 186. The hole 186 is generally configured to receive one of the knurled thumbscrews 175 that may be used to attach the frame clips 172 to the right-hand short leg sections 122.

Referring to FIGS. 12A-12F, diagrams are shown illustrating a top view (FIG. 12A), a front (exterior) elevation (FIG. 12B), an end elevation (FIG. 11C), a back (interior) elevation (FIG. 12D), a hinge detail (FIG. 11E), and a cross-sectional view (FIG. 11F) of a left-hand short leg section 124 of the foldable base frame 102. In various embodiments, the left-hand short leg sections 124 may be formed from various materials including, but not limited to, aluminum, steel, or any other metallic material, wood, polymeric, and/or composite material having sufficient strength and rigidity. In an example, the left-hand short leg sections 124 may be manufactured using high-density polyethylene (HDPE). In an example, the left-hand short leg sections 124 may be manufactured using a blow molding process. In another example, the left-hand short leg sections 124 may be manufactured using an injection molding process.

Figure 12A:
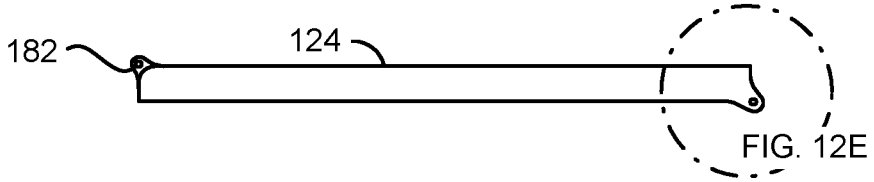
FIGS. 12A-12F are diagrams illustrating views of a second short leg section of the base frame of the foldable breathe-through mattress.
Figure 12B:
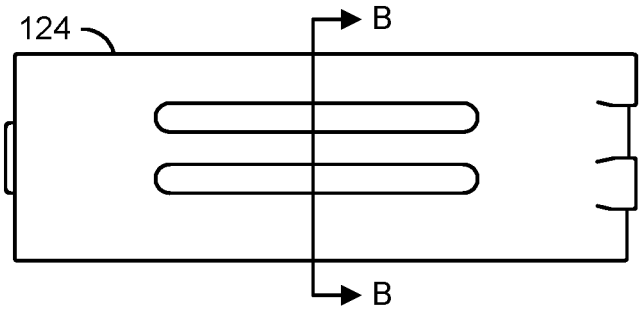
Figure 12C:
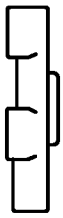
Figure 12D:
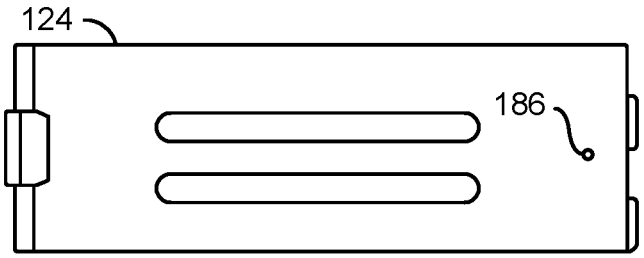
Figure 12E:
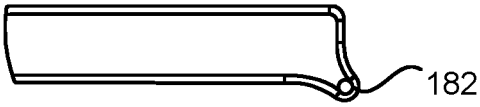
Figure 12F:
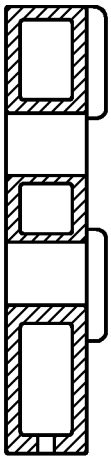

In an example, the ends of the left-hand short leg sections 124 generally comprise hinge features that define holes (or channels) 182 which are configured to receive the hinge pins 154. In an example, when the hinge pins 154 comprise one-eighth inch diameter stainless steel rods, the holes 182 may be implemented having a diameter of about one-eighth inch. In various embodiments, the left-hand short leg sections 124 generally have rounded corners and edges to prevent injury. As shown in FIG. 12D, an interior surface of the left-hand short leg sections 124 generally define a hole 186. The hole 186 is generally configured to receive one of the knurled thumbscrews 175 that may be used to attach the frame clips 172 to the left-hand short leg sections 124.

Figure 13A:
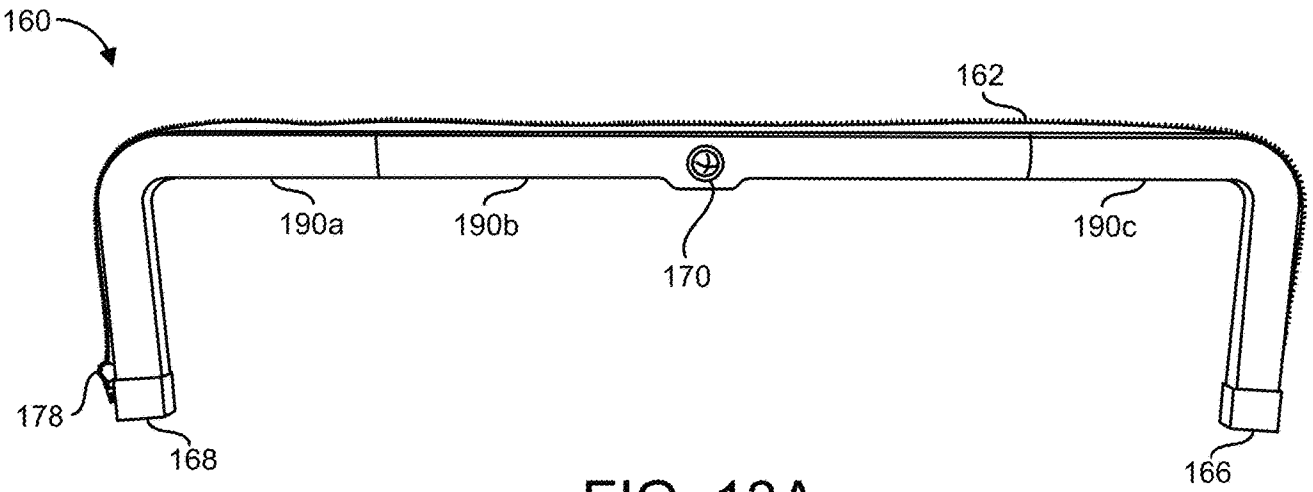
FIGS. 13A and 13B are diagrams illustrating a top view and a bottom view, respectively, of an arm of the top frame assembly.
Figure 13B:
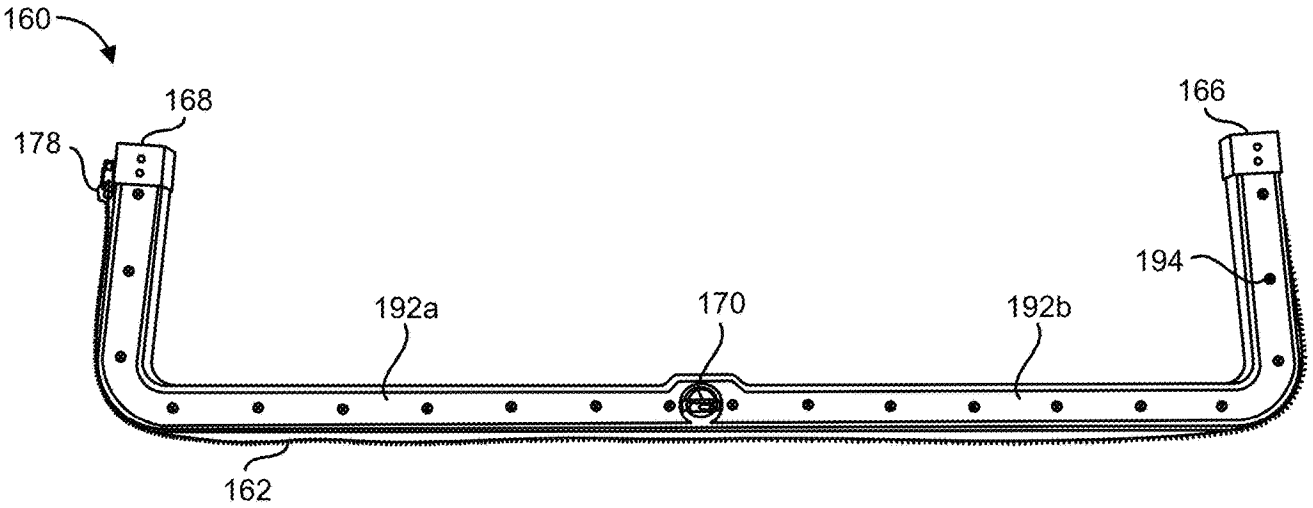

Referring to FIGS. 13A and 13B, diagrams are shown illustrating a top view (FIG. 13A) and a bottom view (FIG. 13B), respectively, of an arm 160 of the top frame assembly 104. In an example, the arms 160 may comprise a first ninety-degree bend section 190*a*, a center section 190*b*, and a second ninety-degree bend section 190*c*. The center section 190*b* generally comprises the male latch member 170. The first ninety-degree bend section 190*a* and the second ninety-degree bend section 190*c* are generally attached on opposite ends of the center section 190*b*. In an example, the arms 160 may further comprise a first bottom plate 192*a* and a second bottom plate 192*b*. The bottom plates 192*a* and 192*b* may be attached to the arms 160 by a plurality of fasteners (e.g., machine screws, etc.). The bottom plates 192*a* and 192*b* are generally configured to enclose a bottom surface of the arms and entrap the zipper halves 162. In an example, distal end caps 166 and 168 are generally attached to free ends of the first ninety-degree bend section 190*a* and the second ninety-degree bend section 190*c*. The distal end caps 166 and 168 are generally configured to facilitate attaching the hinges 174 and 176 to the arms 160.

In various embodiments, the first ninety-degree bend section 190*a*, the center section 190*b*, and the second ninety-degree bend section 190*c* of the arms 160 generally have rounded corners and edges to prevent injury. In various embodiments, the first ninety-degree bend section 190*a*, the center section 190*b*, and the second ninety-degree bend section 190*c* of the arms 160 may be formed from various materials including, but not limited to, aluminum, steel, or any other metallic material, wood, polymeric, and/or composite material having sufficient strength and rigidity. In an example, the first ninety-degree bend section 190*a*, the center section 190*b*, and the second ninety-degree bend section 190*c* of the arms 160 may be manufactured using high-density polyethylene (HDPE). In another example, the first ninety-degree bend section 190*a*, the center section 190*b*, and the second ninety-degree bend section 190*c* of the arms 160 may be manufactured using acrylonitrile butadiene styrene (ABS). In an example, the first ninety-degree bend section 190*a*, the center section 190*b*, and the second ninety-degree bend section 190*c* of the arms 160 may be manufactured using a blow molding process. In another example, the first ninety-degree bend section 190*a*, the center section 190*b*, and the second ninety-degree bend section 190*c* of the arms 160 may be manufactured using an injection molding process. However, other types of manufacturing processes may be used. In an example, the bottom plates 192*a* and 192*b* may be manufactured using acrylonitrile butadiene styrene (ABS).

Figure 14:
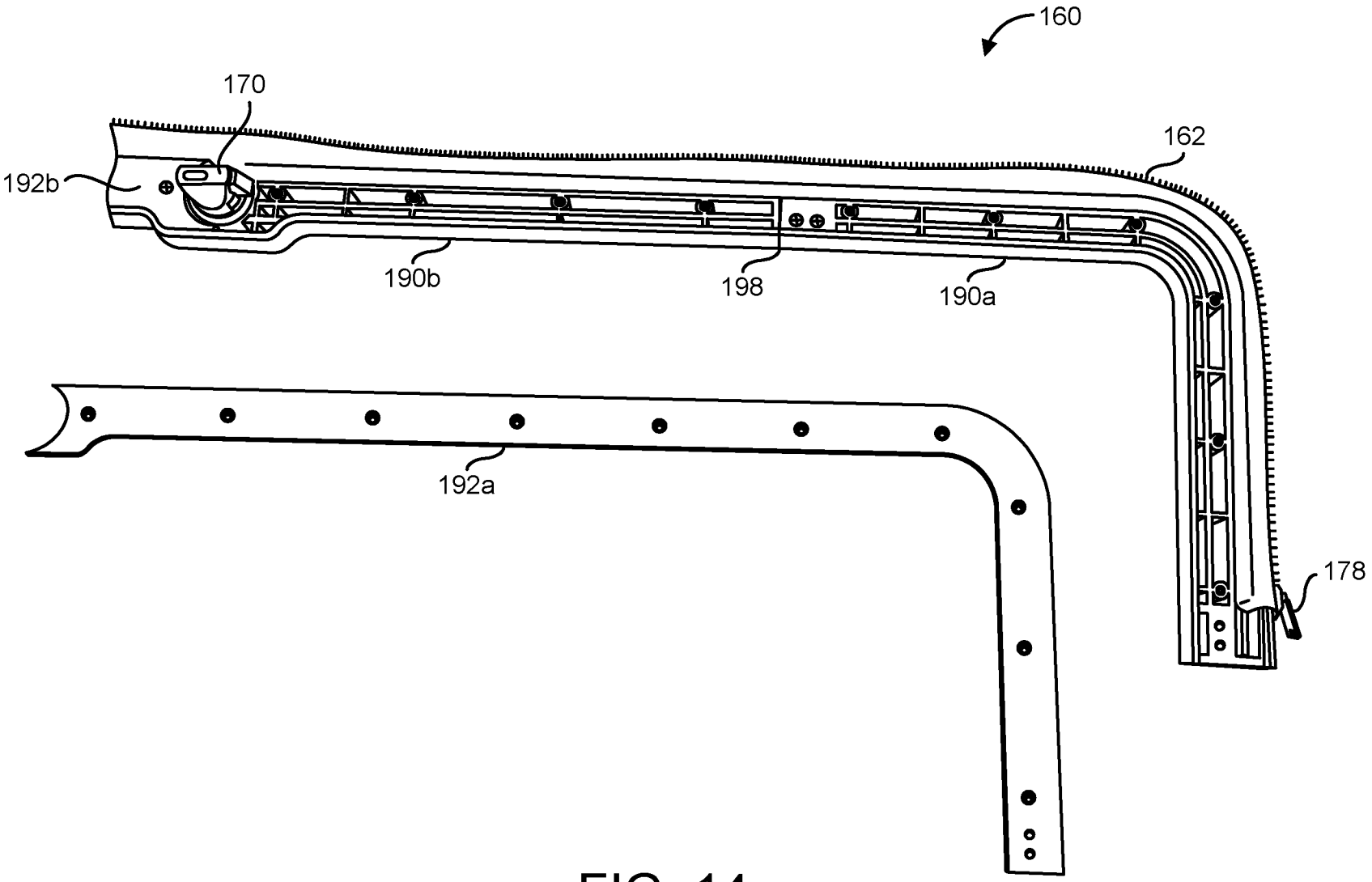
FIG. 14 is a diagram illustrating an internal view of one side of an arm of the top frame assembly.

Referring to FIG. 14, a diagram is shown illustrating an internal view of one side of an arm 160 of the top frame assembly 104. In an example, the arm 160 is shown with the bottom plate 192*a* removed. In an example, the first ninety-degree bend section 190*a* and the center section 190*b* are rigidly coupled together by a mortise and tenon joint 198. In an example, each of the arms 160 may comprise (define) an interior space configured to entrap a respective zipper half 162 with the section of tubing inserted into the open woven channel of the zipper half 162. The zipper half 162 is entrapped within the arm 160 when the bottom plates 192*a* and 192*b* are attached to the first ninety-degree bend section 190*a*, the center section 190*b*, and the second ninety-degree bend section 190*c*.

Figure 15:
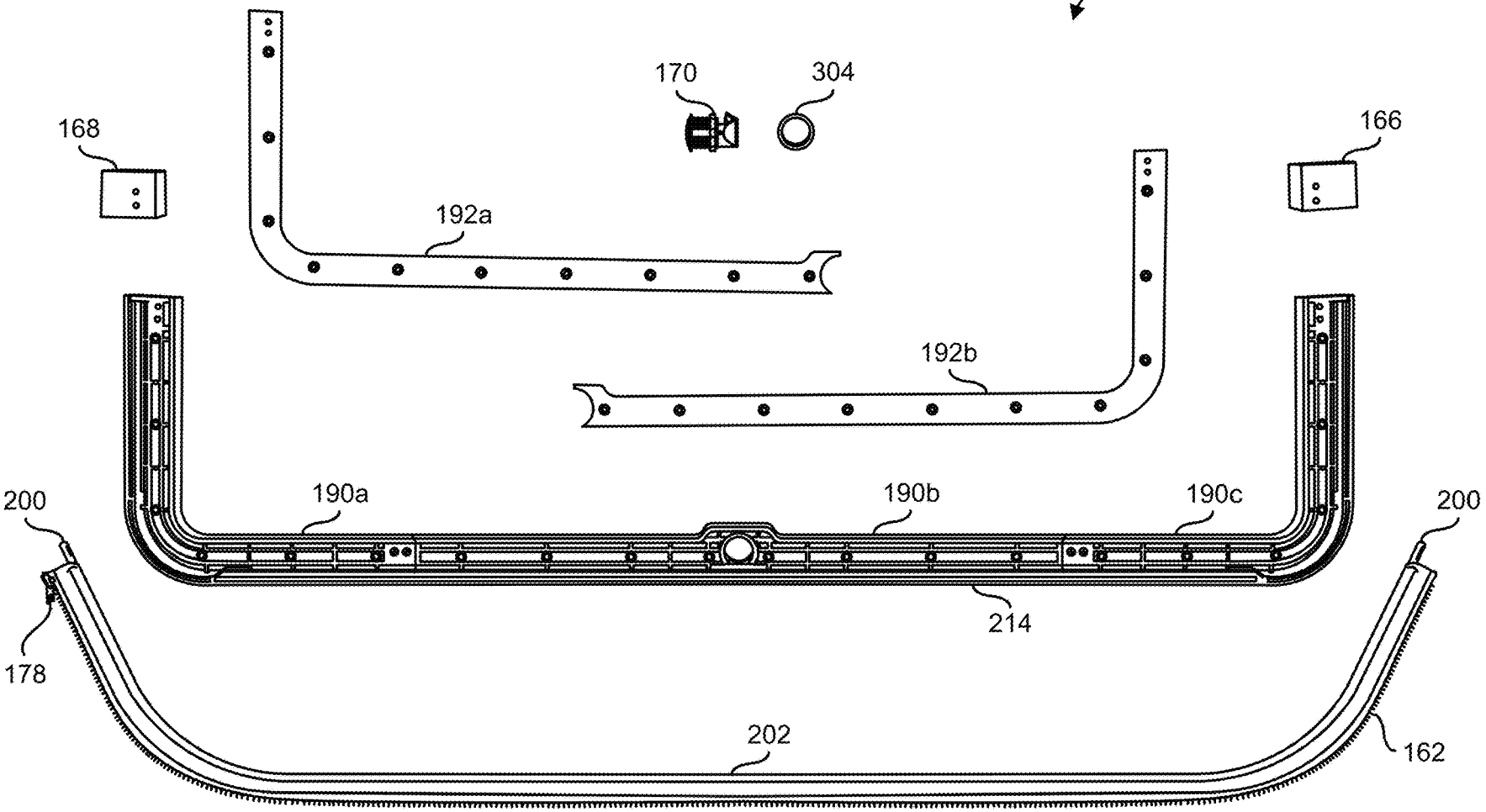
FIG. 15 is a diagram illustrating a disassembled view of an arm of the top frame assembly.

Referring to FIG. 15, a diagram is shown illustrating a disassembled view of an arm 160 of the top frame assembly 104 in accordance with an embodiment of the invention. In an example, the zipper half 162 is configured to run approximately along an entire perimeter length of the arm 160. A section of tubing 200 is generally inserted into the open woven channel 202 of the zipper half 162. The open woven channel 202 and the tubing 200 generally run along an entire length of the zipper half 162. In an example, the tubing 200 may comprise a polyethylene tubing. In another example, the tubing 200 may comprise silicone tubing or beading. The open woven channel portion 202 of the zipper half 162 is generally placed within an interior space of the arm 160 configured to entrap the open woven channel portion 202 of the zipper half 162 with the section of tubing 200 inserted into the open woven channel when the bottom plates 192*a* and 192*b* are attached to the first ninety-degree bend section 190*a*, the center section 190*b*, and the second ninety-degree bend section 190*c*. In addition to the zipper half 162, the arm 160 may comprise a stiffener 214. In an example, the stiffener 214 generally extends across the center section 190*b* and into the first ninety-degree bend section 190*a* and the second ninety-degree bend section 190*c*. In another example, the stiffener may be configured to extend around a large portion of the periphery of the arm 160. In an example, the stiffener 214 may be formed using a section of 5 mm steel plate. In an example, the stiffener 214 may be fastened to internal structures of the first ninety-degree bend section 190*a*, the center section 190*b*, and the second ninety-degree bend section 190*c*.

Figure 16:
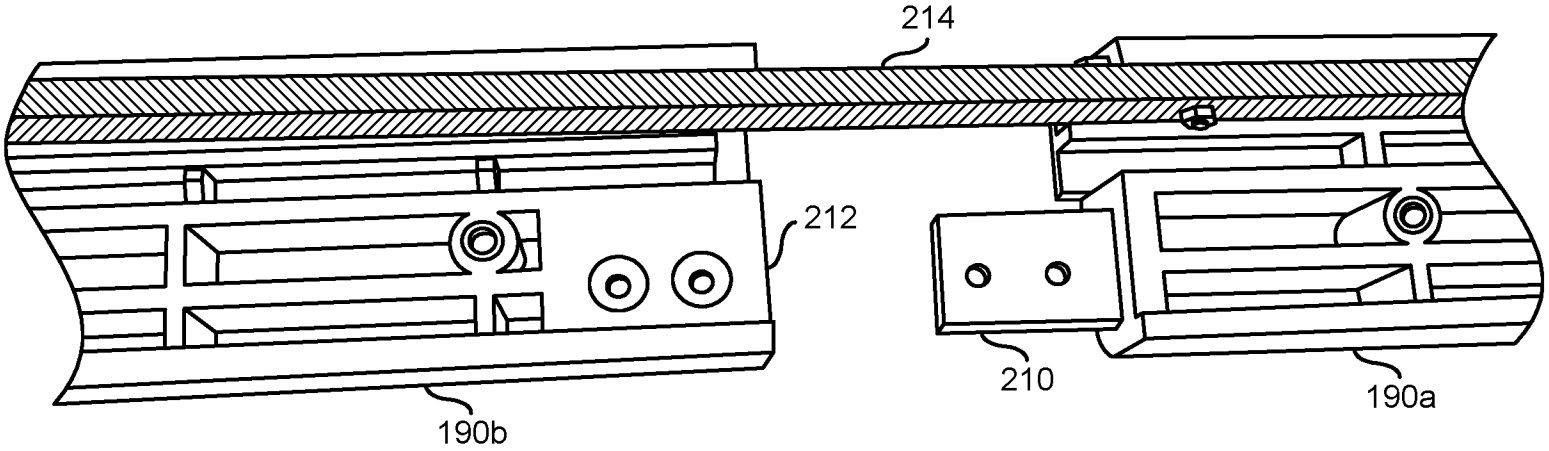
FIG. 16 is a diagram illustrating a mortise and tenon connection and a stiffener bar of an arm of the top frame assembly.

Referring to FIG. 16, a diagram is shown illustrating a detailed view of a mortise and tenon connection and a stiffener bar of an arm 160 in accordance with an embodiment of the invention. In an example, the first ninety-degree bend section 190*a* may comprise a tenon 210 and the center section 190*b* may comprise a mortise 212. The tenon 210 and the mortise 212 are generally configured to form the joint 198 which rigidly connects the first ninety-degree bend section 190*a* to the center section 190*b*. The second ninety-degree bend section 190*c* is generally connected similarly to the center section 190*b*. In an example, the tenon 210 and the mortise 212 may be locked together using a couple of fasteners (e.g., machine screws, etc.).

Figure 17:
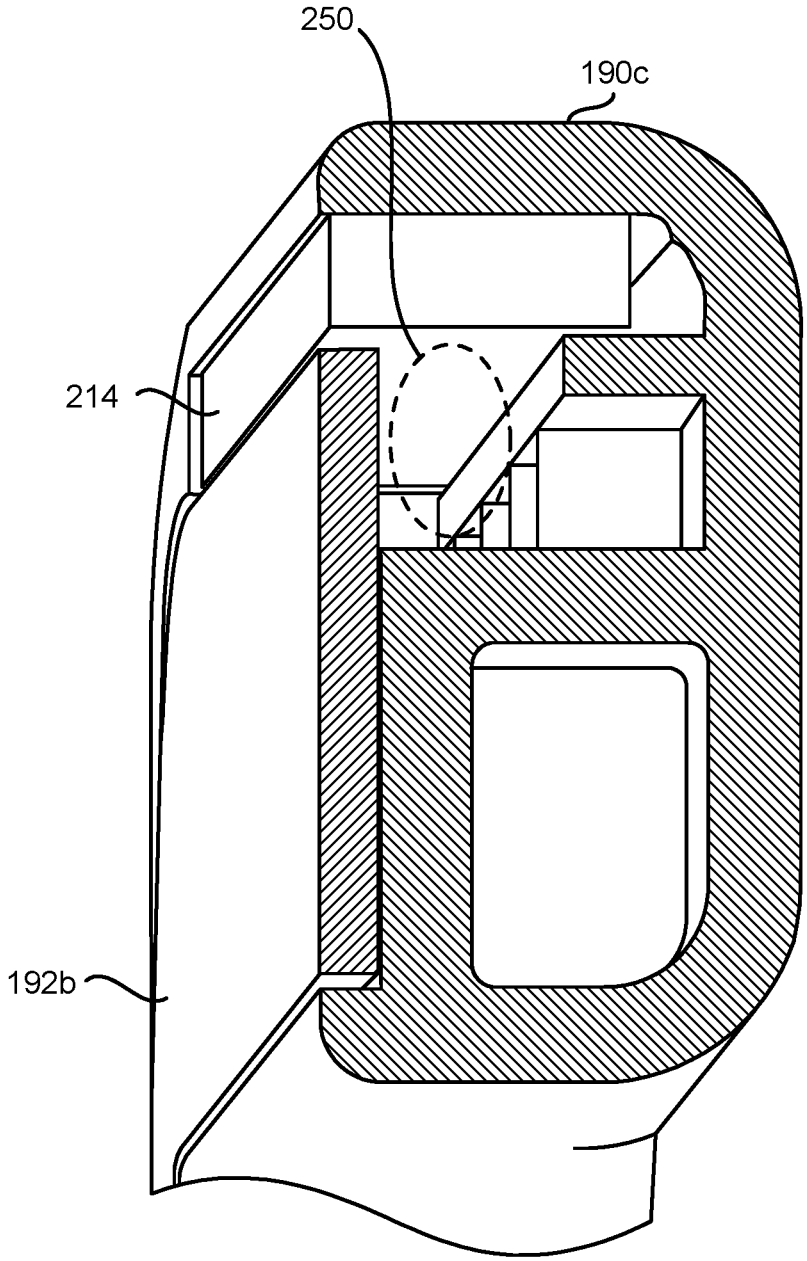
FIG. 17 is a cross-sectional view of an arm of the top frame assembly illustrating a space for entrapping a zipper half for attaching the topper.

Referring to FIG. 17, a diagram is shown illustrating a cross-sectional view of an arm 160 in accordance with an embodiment of the invention. In an example, the arm 160 generally defines an internal space 250 configured for entrapping the zipper half 162. In an example, the internal space 250 of the arm 160 is generally configured to entrap the zipper half 162 with the section of tubing inserted into the open woven channel 202 when the bottom plates 192*a* and 192*b* are attached. In an example, with the open woven channel 202 holding the tubing 200 in the internal space 250, a remainder of the zipper half 162 extends outside the arm 160 through a gap between the bottom plates 192*a* and 192*b* and the stiffener 214.

Figure 18A:
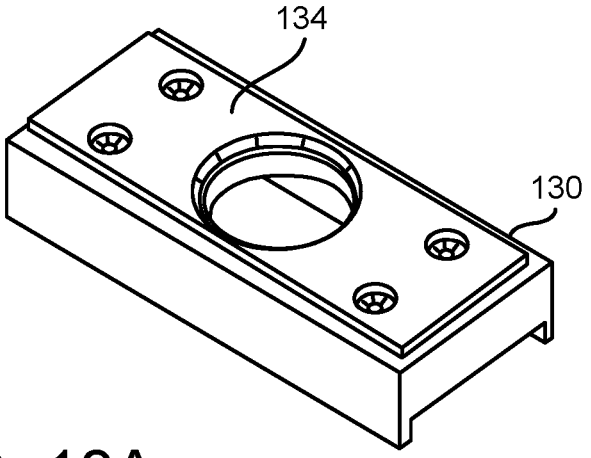
FIGS. 18A-18C are diagrams illustrating a lock plate assembly of the base frame which engages a push-to-close latch with pop-out knob that may be used to lock the arms of the top frame assembly to the base frame.
Figure 18B:
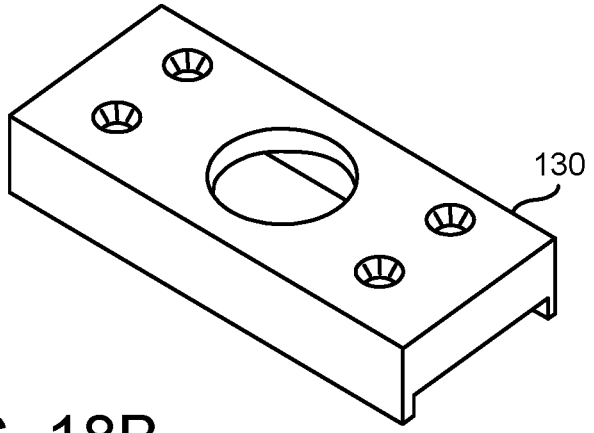
Figure 18C:
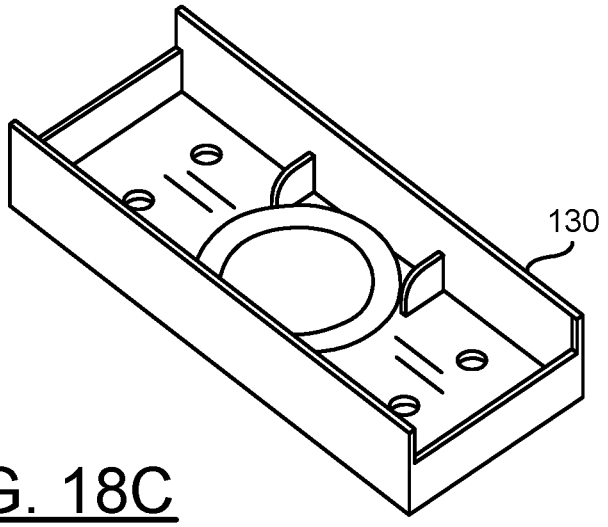

Referring to FIGS. are shown Referring to 18A-18C, diagrams illustrating the female member 130 of a latch assembly which, when mounted on the foldable base frame 102, engages a push-to-close latch with pop-out knob that may be used to lock the arms 160 of the top frame assembly 104 to the foldable base frame 102. In an example illustrated in FIG. 18A, the female member 130 may have a spacer 134 attached depending on a distance between the arm 160 and the foldable base frame 102. In another example, the spacer 134 may be omitted when not needed (e.g., as illustrated by FIG. 18B. In various embodiments, an interior of the female member 130 (e.g., illustrated in FIG. 18C) is generally configured to engage with the mounting feature 184 of the long leg sections 118. In an example, the female member 130 may be fastened to the mounting feature 184 of the long leg sections 118 using a number of fasteners (e.g., screws, etc.).

Figure 19:
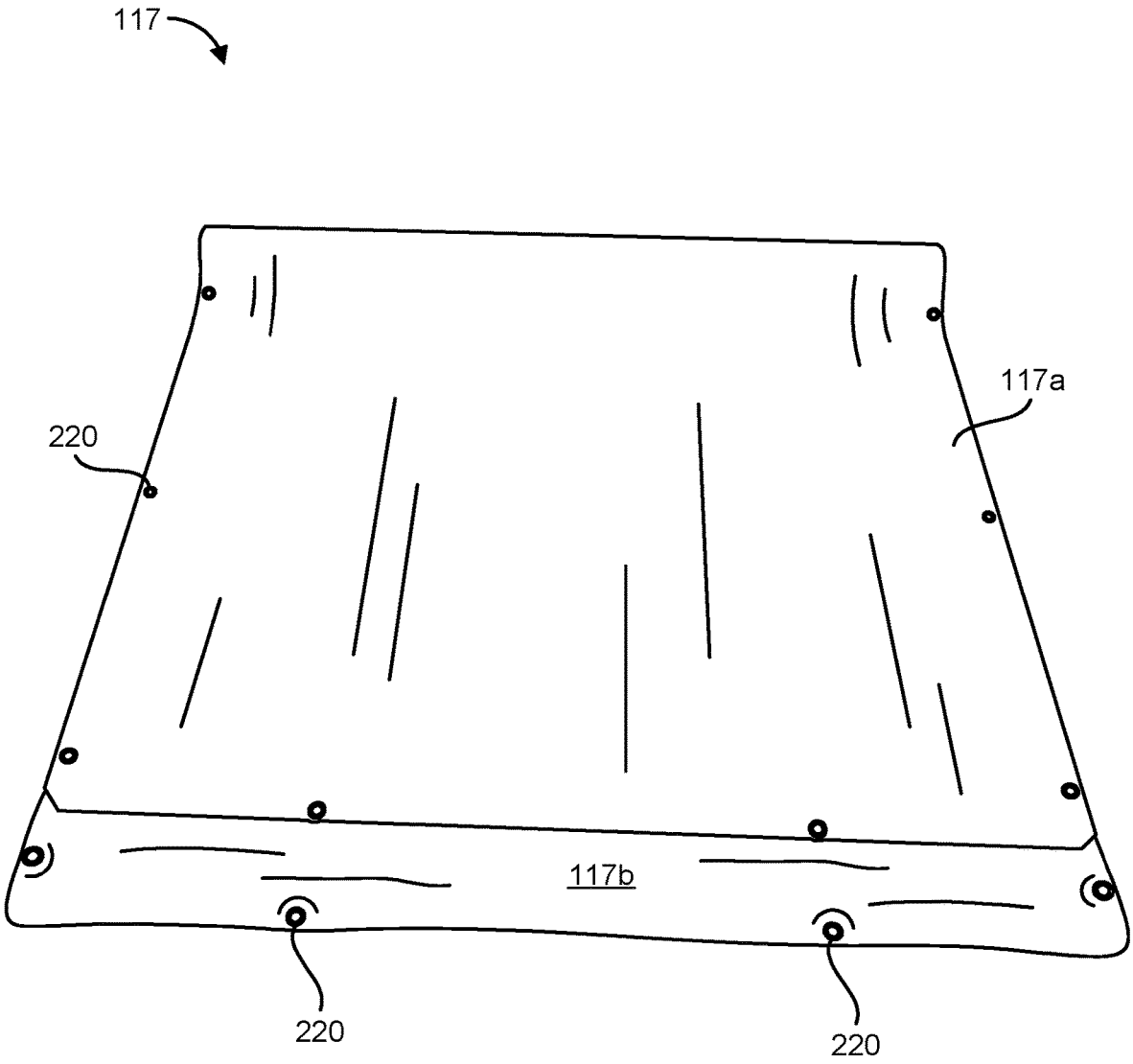
FIG. 19 is a diagram illustrating a silicone mat that attaches to the bottom of the base frame of the foldable breathe-through mattress.

Referring to FIG. 19, a diagram is shown illustrating a siliconized mat that attaches to the bottom of the base frame of the foldable breathe-through mattress. In an example, the flexible bottom mat 117 may have a first side 117*a* that is an exposed fabric side of the bottom mat and a second side 117*b* that is impregnated with silicone (or other treatment) to provide a fluid proof barrier. The flexible bottom mat 117 is generally mounted to the base frame 102 with the siliconized side 117*b* facing inward toward the enclosed cavity of the foldable breathe-through mattress 100. The silicone coating generally allows any fluid passing through the topper 106 to be caught in the cavity of the foldable breathe-through mattress 100 to reduce cleanup. In an example, the flexible mat 117 may be attached to a bottom surface of the long leg sections 118, the right-hand short leg sections 122, and the left-hand short leg sections 124. In an example, the flexible mat may be connected to the long leg sections 118, the right-hand short leg sections 122, and the left-hand short leg sections 124 using nylon rivets that are press-fit into holes 180 in the bottom surface of the long leg sections 118, the right-hand leg sections 122, and the left-hand short leg sections 124. In an example, the flexible mat 117 may define a plurality of holes 220 around a periphery of the flexible mat 117 through which the nylon rivets may be passed to attach the flexible mat 117 to the bottom surface of the long leg sections 118, the right-hand short leg sections 122, and the left-hand short leg sections 124.

Figure 20:
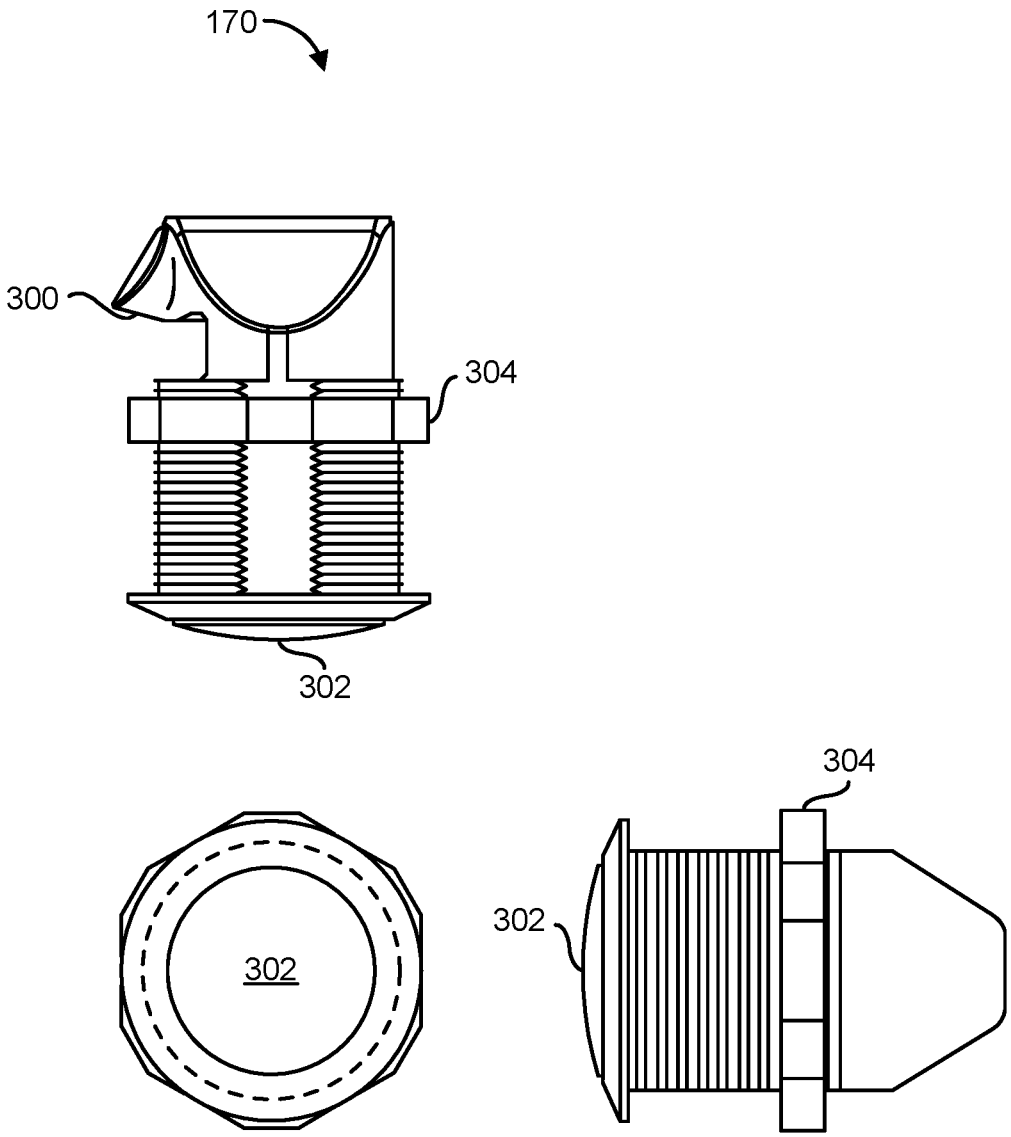
FIG. 20 is a diagram illustrating a push-to-close latch with pop-out knob in accordance with an embodiment of the invention.

Referring to FIG. 20, a diagram is shown illustrating a push-to-close latch with pop-out knob in accordance with an embodiment of the invention. In an example, a push-to-close latch with pop-out knob is generally used to implement the male member of the latch assemblies of the arms 160 of the top frame assembly 104. In an example, the male members 170 of the latch assemblies may have a latching pawl 300 that may be spring-loaded such that the male members 170 may be pressed or snapped into engagement with the female members 130 mounted on the foldable base frame 102. A user may release the engagement between the male members 170 and the female members 130 by releasing and rotating a knob 302 of the male members 170. In an example, the knob 302 of the male members 170 may be configured as push-to-lock, push-to-release. When the knob 302 is pushed to lock, the knob 302 generally becomes latched in a position that is flush with a top surface of the male members 170. When the knob 302 is pushed to release, the knob 302 is generally configured to pop up above the top surface of the male members 170 to allow the knob 302 to be rotated to unlatch the male members 170 from the female members 130. In an example, the male members 170 are attached to the arms 160 by nuts 304. In an example, the nut 304 is configured to fit within a depression in a bottom surface of the arms 160 between the bottom plates 192*a* and 192*b*.

With reference to FIGS. 1-20, operation of the foldable breathe-through crib mattress (or sleep surface) 100 has been described in detail. As described above, the topper 106 is formed from breathable materials that allow passive flow of gases and liquids there-through. The top frame assembly 104 generally retains the topper 106 in tension over the foldable base frame 102 and bottom mat 152 to form an enclosed cavity. The foldable base frame 102 may function as a receptacle for bodily fluids and other liquids that may come into contact with the topper 106. The materials and structure of the topper 106 generally provides a more sanitary sleeping surface for an infant and prevents the infant from re-breathing a potentially harmful level of exhaled carbon dioxide.

To install the topper 106 onto the top frame assembly 104, the zipper half 116 of a first side of the topper 106 is zipped to the entrapped zipper half of one arm 160 of the top frame assembly 104. The arms 160 of the top frame assembly 104 are held in the open position while the zipper half 116 of a second side of the topper 106 is zipped to the entrapped zipper half of the other arm 160 of the top frame assembly 104. Once the topper 106 has been zipped onto the arms 160 of the top frame 104, the arms 160 may be moved to the closed position and the male members 170 of the latch assemblies locked into the female members 130 attached to the foldable base frame 102.

Moving the first and second arms 160 of the top frame 104 into the closed position applies a tension force on the topper 106, such that the topper 106 is substantially taut when the arms 160 of the top frame assembly 104 are in the closed position. Such tension in the toper 106 allows the topper 106 to be suspended over the foldable base frame 102 and support the weight of the infant while maintaining the spacing between the topper 106 and the bottom mat 152 forming the enclosed cavity of the foldable base frame 102.

As described above, the "spacer" fabric of the topper 106 generally allows substantially free flow of air up and down through the topper 106. Air passage and circulation is aided by the enclosed cavity defined by the foldable base frame 102 and the openings 120 in the long leg sections 118 and the right-hand and left-hand short leg sections 122 and 124. Such structure and function allows an infant to lie face-down on the topper 106 and not re-breath a potentially harmful level of carbon dioxide and/or germs, for example. The "spacer" fabric wicks liquids and moisture away from the outer surface of the topper 106, providing numerous health, safety and hygienic benefits over conventional mattresses. The substantially free flow of air also allows the infant to maintain a relatively consistent body temperature compared to conventional mattresses or plastic protective sheets, for example. The topper 106 further provides a resilient support surface reducing the likelihood of plagiocephely (commonly referred to has "flat head syndrome"), which can develop in infants. Furthermore, due to the ease of installation and removability of the topper 106 and the bottom mat 152, the topper 106 and the bottom mat 152 may be quickly and easily removed from the foldable breathe-through crib mattress (or sleep surface) 100 and washed in a conventional washing machine to remove stains, bacteria, and other matter.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be used with an intention to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments. Furthermore, designating or describing an element, component, region, layer or section as a first element, component, region, layer or section does not necessarily require the presence or inclusion of a second element, component, region, layer or section.

Spatially relative terms, such as "inner," "outer," "beneath," "below," "lower," "above," "upper," and the like, may be used herein for ease of description to describe a relationship of one element or feature to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terms "may" and "generally" when used herein in conjunction with "is (are)" and verbs are meant to communicate the intention that the description is exemplary and believed to be broad enough to encompass both the specific examples presented in the disclosure as well as alternative examples that could be derived based on the disclosure. The terms "may" and "generally" as used herein should not be construed to necessarily imply the desirability or possibility of omitting a corresponding element.

While the invention has been particularly shown and described with reference to embodiments thereof, it will be understood by those skilled in the art that various changes in form and details may be made without departing from the scope of the invention.

The invention claimed is:

1. A foldable breathe-through mattress comprising:

a foldable base frame comprising a first long leg section, a second long leg section, a first right-hand short leg section, a second right-hand short leg section, a first left-hand short leg section, and a second left-hand short leg section connected together by a plurality of hinged connections to form sidewalls of the foldable base frame;

a top frame assembly comprising a first arm, a second arm, a first zipper half, a second zipper half, a first frame clip, and a second frame clip, wherein the first zipper half is attached to a first outside edge of the first arm, the second zipper half is attached to a second outside edge of the second arm, the first frame clip is removably attached to respective interior surfaces of the first right-hand short leg section and the first left-hand short leg section by a first pair of fasteners, wraps over respective top surfaces of the first right-hand short leg section and the first left-hand short leg section, and extends down respective exterior surfaces of the first right-hand short leg section and the first left-hand short leg section around a first hinged connection of the plurality of hinged connections between the first right-hand short leg section and the first left-hand short leg section, the second frame clip is removably attached to respective interior surfaces of the second right-hand short leg section and the second left-hand short leg section by a second pair of fasteners, wraps over respective top surfaces of the second right-hand short leg section and the second left-hand short leg section, and extends down respective exterior surfaces of the second right-hand short leg section and the second left-hand short leg section around a second hinged connection of the plurality of hinged connections between the second right-hand short leg section and the second left-hand short leg section, and the first arm and the second arm are attached by hinges to the first frame clip and the second frame clip;

a flexible mat removably attached to a bottom surface of the foldable base frame; and a topper removably attached to the first arm and the second arm of the top frame assembly, wherein the topper comprises a third zipper half and a fourth zipper half, the third zipper half connects to the first zipper half, and the fourth zipper half connects to the second zipper half.

2. The foldable breathe-through mattress according to claim 1, wherein the first long leg section, the second long leg section, the first right-hand short leg section, the second right-hand short leg section, the first left-hand short leg section, and the second left-hand short leg section comprise a plurality of fingers configured to form the plurality of hinged connections with one another and the plurality of hinged connections enable the first right-hand short leg section, the second right-hand short leg section, the first left-hand short leg section, and the second left-hand short leg section to fold between the first long leg section and the second long leg section.

3. The foldable breathe-through mattress according to claim 1, wherein the first long leg section, the second long leg section, the first right-hand short leg section, the second right-hand short leg section, the first left-hand short leg section, and the second left-hand short leg section are connected to one another with stainless steel hinge pins.

4. The foldable breathe-through mattress according to claim 1, wherein the first long leg section, the second long leg section, the first right-hand short leg section, the second right-hand short leg section, the first left-hand short leg section, and the second left-hand short leg section comprise a high-density polyethylene material.

5. The foldable breathe-through mattress according to claim 1, wherein the first long leg section, the second long leg section, the first right-hand short leg section, the second right-hand short leg section, the first left-hand short leg section, and the second left-hand short leg section comprise at least one of blow molded structures and injection molded structures.

6. The foldable breathe-through mattress according to claim 1, wherein the foldable base frame, the first arm, and the second arm have rounded corners and edges to prevent injury.

7. The foldable breathe-through mattress according to claim 1, wherein the first frame clip and the second frame clip are each removably attached to the foldable base frame by a respective pair of knurled thumbscrews to enable ease of assembly and disassembly.

8. The foldable breathe-through mattress according to claim 1, wherein the first frame clip and the second frame clip are each removably attached to the foldable base frame by a respective pair of captive knurled thumbscrews that are not removable from the first frame clip and the second frame clip to avoid at least one of loss or a potential choking hazard.

9. The foldable breathe-through mattress according to claim 1, wherein:

the first frame clip and the second frame clip lock the foldable base frame in an unfolded position.

10. The foldable breathe-through mattress according to claim 1, wherein:

the first zipper half comprises a first entrapped zipper half;

the second zipper half comprises a second entrapped zipper half; and the first entrapped zipper half and the second entrapped zipper half each comprise an open woven channel running a length of the first entrapped zipper half and the second entrapped zipper half and configured to hold a section of tubing.

11. The foldable breathe-through mattress according to claim 10, wherein the section of tubing comprises quarter-inch diameter polyethylene tubing.

12. The foldable breathe-through mattress according to claim 10, wherein:

the first arm comprises a first interior space configured to entrap the open woven channel of the first entrapped zipper half with a first section of tubing inserted in the open woven channel of the first entrapped zipper half; and the second arm comprises a second interior space configured to entrap the open woven channel of the second entrapped zipper half with a second section of tubing inserted in the open woven channel of the second entrapped zipper half.

13. The foldable breathe-through mattress according to claim 1, wherein:

the first arm comprises a first latch assembly configured to automatically latch the first arm to the foldable base frame when the first arm is pressed against the foldable base frame, wherein the first latch assembly has a first push-to-lock, push-to-release knob which unlatches the first arm from the foldable base frame when the first push-to-lock, push-to-release knob is turned after being released; and the second arm comprises a second latch assembly configured to automatically latch the second arm to the foldable base frame when the second arm is pressed against the foldable base frame, wherein the second latch assembly has a second push-to-lock, push-to-release knob which unlatches the second arm from the foldable base frame when the second push-to-lock, push-to-release knob is turned after being released.

14. The foldable breathe-through mattress according to claim 1, wherein the topper comprises a first layer and a second layer, the first layer comprises an open-weave knitted fabric to allow airflow there-through, and the second layer comprises a single piece of breathable polyester netting that is substantially inelastic and dimensionally stable such that the breathable polyester netting has little or no stretch when placed under tension loads.

15. The foldable breathe-through mattress according to claim 14, wherein the first layer comprises a fabric including at least one of fluid-wicking yarns and fluid-wicking fibers that are warp-knitted in an open-weave fashion.

16. The foldable breathe-through mattress according to claim 14, wherein the second layer is sewn across a plane of an underside of the topper to increase firmness.

17. The foldable breathe-through mattress according to claim 1, wherein the foldable base frame, the top frame assembly, the flexible mat, and the topper cooperate to form a cavity, the cavity provides a receptacle for bodily fluids, and the foldable base frame defines a plurality of openings extending there-through and in communication with the cavity.

18. The foldable breathe-through mattress according to claim 1, wherein the first zipper half, the second zipper half, the third zipper half, and the fourth zipper half comprise size #10 flat coil zippers.

19. A method of supporting a person comprising:

opening a foldable base frame, wherein the foldable base frame comprises a first long leg section, a second long leg section, a first right-hand short leg section, a second right-hand short leg section, a first left-hand short leg section, and a second left-hand short leg section connected together by a plurality of hinged connections to form sidewalls of the foldable base frame;

removably attaching a flexible mat to a bottom surface of the foldable base frame;

attaching a top frame assembly to the foldable base frame, wherein (i) the top frame assembly comprises a first arm, a second arm, a first zipper half, a second zipper half, a first frame clip, and a second frame clip, (ii) the first zipper half is attached to a first outside edge of the first arm, (iii) the second zipper half is attached to a second outside edge of the second arm, (vi) the first frame clip is removably attached to respective interior surfaces of the first right-hand short leg section and the first left-hand short leg section by a first pair of fasteners, wraps over respective top surfaces of the first right-hand short leg section and the first left-hand short leg section, and extends down respective exterior surfaces of the first right-hand short leg section and the first left-hand short leg section around a first hinged connection of the plurality of hinged connections between the first right-hand short leg section and the first left-hand short leg section, (v) the second frame clip is removably attached to respective interior surfaces of the second right-hand short leg section and the second left-hand short leg section by a second pair of fasteners, wraps over respective top surfaces of the second right-hand short leg section and the second left-hand short leg section, and extends down respective exterior surfaces of the second right-hand short leg section and the second left-hand short leg section around a second hinged connection of the plurality of hinged connections between the second right-hand short leg section and the second left-hand short leg section, and (vi) the first and the second arms are attached by hinges to the first and the second frame clips;

attaching a topper to the first arm and the second arm of the top frame assembly, wherein the topper comprises a third zipper half and a fourth zipper half, the third zipper half connects to the first zipper half, and the fourth zipper half connects to the second zipper half;

moving the first arm and the second arm of the top frame assembly into a closed position; and latching the first arm and the second arm of the top frame assembly to the foldable base frame in the closed position to tension the topper.

* * * * *